US006237303B1

(12) United States Patent
Allen et al.

(10) Patent No.: US 6,237,303 B1
(45) **Date of Patent: *May 29, 2001**

(54) STEEL FRAME STRESS REDUCTION CONNECTION

(75) Inventors: Clayton Jay Allen, Laguna Niguel; James Edward Partridge, Pasadena, both of CA (US); Ralph Michael Richard, Tucson, AZ (US)

(73) Assignee: Seismic Structural Design, Laguna Niguel, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/957,516

(22) Filed: Oct. 24, 1997

Related U.S. Application Data

(63) Continuation-in-part of application No. 08/522,740, filed on Oct. 28, 1997, now Pat. No. 5,680,738, which is a continuation-in-part of application No. 08/419,671, filed on Apr. 11, 1995, now abandoned.

(51) Int. Cl.[7] ..... E04C 3/30

(52) U.S. Cl. ..... 52/729.1; 52/653.1; 52/736.2; 52/737.2

(58) Field of Search ..... 52/650.3, 653.1, 52/656.9, 729.1, 736.2, 737.2; 403/265, 270, 271, 272

(56) References Cited

U.S. PATENT DOCUMENTS

| | | | | |
|---|---|---|---|---|
| Re. 22,905 | | 8/1947 | Scheyer . | |
| 1,320,072 | * | 10/1919 | Long | 52/608 |
| 1,594,505 | | 8/1926 | Frye . | |
| 1,813,118 | | 7/1931 | Edwards et al. . | |
| 1,883,376 | | 10/1932 | Hilpert et al. . | |
| 2,822,897 | | 2/1958 | Peterson . | |
| 3,295,288 | * | 1/1967 | Bakke et al. | 52/741.1 |
| 3,716,957 | * | 2/1973 | Bernardi | 52/729.1 X |
| 3,716,959 | * | 2/1973 | Bernardi | 52/729.1 X |
| 4,129,974 | * | 12/1978 | Ojalvo | 52/729.1 |
| 4,905,436 | * | 3/1990 | Matsuo et al. | 52/483.1 X |

(List continued on next page.)

FOREIGN PATENT DOCUMENTS

| | | | | |
|---|---|---|---|---|
| 404339935 | * | 11/1992 | (JP) | 52/737.2 |
| 6-313334 | | 11/1994 | (JP) . | |
| 406313334 | * | 11/1994 | (JP) | 52/736.2 |

OTHER PUBLICATIONS

S.P. Timoshenko and J.N. Goodier, "Theory of Elasticity", McGraw–Hill, Inc. (1934), pp. 159–160.

Charles G. Salmon and John E. Johnson, Steel Structures—Design and Behavior (Second Edition), Harper & Row Publishers, Inc. (1980).

"Full Scale Cyclic Tests", Lee & Lu, Jr. of Str. Div., ASCE, vol. 115, No. 8, (1989), pp 1977–1998.

(List continued on next page.)

*Primary Examiner*—Richard Chilcot
(74) *Attorney, Agent, or Firm*—Small Larkin, LLP

(57) ABSTRACT

The present invention provides for improvement of ductility and strength performance of connections in structural steel buildings made typically with rolled structural shapes, specifically in bolted and/or welded beam-to-column connections with welded flanges, by greatly reducing the very significant uneven stress distribution found in the conventionally designed connection at the column/beam weld, through use of slots in column and/or beam webs with or without continuity plates in the area of the column between the column flanges, as well as, optionally, extended shear plate connections with additional columns of bolts for the purpose of reducing the stress concentration factor in the center of the flange welds. Moreover, the slots in beam web adjacent to the beam flanges allow the beam web and flange to buckle independently thereby eliminating the degrading of the beam strength caused by lateral-torsional bucking.

35 Claims, 24 Drawing Sheets

U.S. PATENT DOCUMENTS

| | | | | |
|---|---|---|---|---|
| 5,148,642 | * | 9/1992 | Plumier et al. | 52/633 X |
| 5,595,040 | * | 1/1997 | Chen | 52/729.1 |
| 5,660,017 | * | 8/1997 | Houghton | 52/655.1 |
| 5,664,380 | * | 9/1997 | Hsueh | 52/653.1 X |
| 5,680,737 | * | 10/1997 | Sheipline | 52/655.1 |
| 5,680,738 | * | 10/1997 | Allen et al. | 52/729.1 |
| 5,848,512 | * | 12/1998 | Conn | 52/729.1 |

OTHER PUBLICATIONS

Manual of Steel Construction Allowable Stress Design, American Institute of Steel Construction, Inc., 9$^{th}$ Ed., 1989, Chapter J. Connections, Joints and Fasteners, pp. 5–161 through 5–163.

"Load and Resistance Factor Design" Specification for Structural Steel Buildings, AISC, Dec. 1, 1993, pp. 6–71; 6–216; and 6–218.

Engelhardt et al., "Cyclic–Loading Performance of Welded Flange–Bolted Web Connections", Dec. 1993, ASCE Journal of Structural Engineering, vol. 119, No. 12, pp. 3537–3550.

Blodgett, O.W., "The Challenge of Welding Jumbo Shapes, Part II: Increasing Ductility of Connections," Welding Innovation Quarterly, 1993.

Blodgett, O.W., "Structural Details to Increase Ductility of Connections", Proceedings; 1994 National Steel Construction Conference, American Institute of Steel Construction, 1994.

American Welding Society, Steel Structural Welding Code 1994, ANSI/AWS D1.1–94, pp. 57–61.

"Load & Resistance Factor Design", vol. II, "Connections", AISC, 2$^{nd}$ Ed., 1994, pp. 8–125 and 8–126.

S.P. Timoshenko and J.N. Goodier, "Theory of Elasticity", McGraw–Hill Inc. (1934), cover page and pp. 159–160.

Charles G. Salmon and John E. Johnson, Steel Structures—Design and Behavior (Second Edition), Harper & Row Publishers, Inc. (1980), Cover page and Table of Contents only.

"Cyclic Tests of Full–Scale Composite Joint Subassemblages", Lee & Lu, Jr. of Str. Div., ASCE, vol. 115, No. 8, (1989), pp 1996–1997.

Manual of Steel Construction Allowable Stress Design, American Institute of Steel Construction, Inc., 9$^{th}$ Ed., 1989 Chapter J. Connections, Joints and Fasteners, cover page and p. 5–162.

"Load and Resistance Factor Design" Specification for Structural Steel Buildings, AISC, Dec. 1, 1993, pp. 6–71; 6–216; and 6–218.

Engelhardt et al., "Cyclic–Loading Performance of Welded Flange–Bolted Web Connections", Dec. 1993, ASCE Journal of Structural Engineering, vol. 119, No. 12, pp. 3537–3550.

Blodgett, O.W., "The Challenge of Welding Jumbo Shapes, Part II: Increasing Ductility of Connections," Welding Innovation Quarterly, 1993.

Blodgett, O.W., "Structural Details to Increase Ductility of Connections", Proceedings; 1994 National Steel Construction Conference, American Institute of Steel Construction, 1994.

American Welding Society, Steel Structural Welding Code 1994, ASNI/AWS D1.1–94, pp. 57–61.

"Load & Resistance Factor Design", vol. II, "Connections", AISC, 2$^{nd}$ Ed., 1994, pp. 8–125 and 8–126.

* cited by examiner

STEEL FRAME STRESS REDUCTION CONNECTION

This is a continuation-in-part of U.S. application Ser. No. 8/522,740, filed Oct. 28, 1997, now U.S. Pat. No. 5,680,738, which is a continuation-in-part of application Ser. No. 08/419,671, filed Apr. 11, 1995; now abandoned.

FIELD OF THE INVENTION

The present invention relates broadly to load bearing and moment frame connections. More specifically, the present invention relates to connections formed between beams and/or columns, with particular use, but not necessarily exclusive use, in steel frames for buildings, in new construction as well as modification to existing structures.

BACKGROUND

In the construction of modern structures such as buildings and bridges, moment frame steel girders and columns are arranged and fastened together, using known engineering principles and practices to form the skeletal backbone of the structure. The arrangement of the girders, also commonly referred to as beams, and/or columns is carefully designed to ensure that the framework of girders and columns can support the stresses, strains and loads contemplated for the intended use of the bridge, building or other structure. Making appropriate engineering assessments of loads represents application of current design methodology. These assessments are compounded in complexity when considering loads for seismic events, and determining the stresses and strains caused by these loads in structures are compounded in areas where earthquakes occur. It is well known that during an earthquake, the dynamic horizontal and vertical inertia loads and stresses, imposed upon a building, have the greatest impact on the connections of the beams to columns which constitute the earthquake damage resistant frame. Under the high loading and stress conditions from a large earthquake, or from repeated exposure to milder earthquakes, the connections between the beams and columns can fail, possibly resulting in the collapse of the structure and the loss of life.

The girders, or beams, and columns used in the present invention are conventional I-beam, W-shaped sections or wide flange sections. They are typically one piece, uniform steel rolled sections. Each girder and/or column includes two elongated rectangular flanges disposed in parallel and a web disposed centrally between the two facing surfaces of the flanges along the length of the sections. The column is typically longitudinally or vertically aligned in a structural frame. A girder is typically referred to as a beam when it is latitudinally, or horizontally, aligned in the frame of a structure. The girder and/or column is strongest when the load is applied to the outer surface of one of the flanges and toward the web. When a girder is used as a beam, the web extends vertically between an upper and lower flange to allow the upper flange surface to face and directly support the floor or roof above it. The flanges at the end of the beam are welded and/or bolted to the outer surface of a column flange. The steel frame is erected floor by floor. Each piece of structural steel, including each girder and column, is preferably prefabricated in a factory according to predetermined size, shape and strength specifications. Each steel girder and column is then, typically, marked for erection in the structure in the building frame. When the steel girders and columns for a floor are in place, they are braced, checked for alignment and then fixed at the connections using conventional riveting, welding or bolting techniques.

While suitable for use under normal occupational loads and stresses, often these connections have not been able to withstand greater loads and stresses experienced during an earthquake. Even if the connections survive an earthquake, that is, don't fail, changes in the physical properties of the connections in a steel frame may be severe enough to require structural repairs before the building is fit for continued occupation.

SUMMARY OF INVENTION

The general object of the present invention is to provide new and improved beam to column connections that reduce stress and/or strain caused by both static and dynamic loading. The improved connection of the present invention extends the useful life of the steel frames of new buildings, as well as that of steel frames in existing buildings when incorporated into a retrofit modification made to existing buildings.

A further object is to provide an improved beam to column connection in a manner which generally, evenly distributes static or dynamic loading, and stresses, across the connection so as to minimize high stress concentrations along the connection.

Another object of the present invention is to reduce a dynamic loading stress applied between the beam and the column flange connection of a steel frame structure.

Yet another object of the present invention is to reduce the variances in dynamic loading stress across the connection between the column and beam.

It is yet another object of the present invention to reduce the variances in dynamic loading stress across the beam to column connection by incorporation of at least one, and preferably several slots in the column web and/or the beam web near the connection of the beam flanges to the column flange.

It is yet another object of the present invention to reduce the strain rate applied between the beam and column flange of a steel frame structure during dynamic loading.

It is yet another object of the present invention to provide a means by which the plastic hinge point of a beam in a steel frame structure may be displaced along the beam away from the beam to column connection, if this feature may be desired by the design engineer.

Finally, it is an object of the present invention to reduce the stresses and strains across the connection of the column and beam of a steel frame structure during static and dynamic loadings.

The present invention is based upon the discovery that non-linear stress and strain distributions due to static, dynamic or impact loads created across a full penetration weld of upper and lower beam flanges to a column flange in a steel frame structure magnify the stress and strain effects of such loading at the vertical centerline of the column flange. Detailed analytical studies of typical, wide flange beam to column connections to determine stress distribution at the beam/column interface had not been made prior to studies performed as part of the research associated with the present invention. strain rate considerations, rise time of applied loads, stress concentration factors, stress gradients, residual stresses and geometrical details of the connection all contribute to the behavior and strength of these connections. By using high fidelity finite element models and analyses to design full scale experiments of a test specimen, excellent correlation has been established between the analytical and test results of measured stress and strain profiles at the beam/column interface where fractures occurred. Location of the strain gauges on the beam flange at the column face was achieved by proper weld surface preparation. Dynamic load tests confirmed the analytically determined high strain gradients and stress concentration factors. These stress concentrations were found to be 4 to 5 times higher than nominal design assumption values for a typical W 27×94 (690×140) beam to W 14×176 (360×262) column connection with no continuity plates. Stress concentrations were reduced to between 3 and 4 times nominal stress level when conventional continuity plates were added. Incorporation of features of present invention into the connection reduces the high-non-uniform stress that exists with conventional design theory and has been analyzed and tested. The present invention changes the local stiffnesses and rigidities of the connection and reduces the stress concentration factor to about 1.2 at the center of the extreme fiber of the flange welds. Explained in a different way, the condition of stress at a conventional connection of the upper and lower beam flanges at the column flange, the beam flanges exhibit non-linear stress and strain distribution. As part of the present invention it has been discovered that this is principally due to the fact that the column web, running along the vertical centerline of the column flanges provides additional rigidity to the beam flanges, primarily at the center of the flanges directly opposite the column web. The result is that the rigidity near the central area of the flange at the beam to column connection can be significantly greater than the beam flange rigidity at the outer edges of the column flange. This degree of rigidity varies as a function of the distance from the column web. In other words, the column flange yields, bends or flexes at the edges and remains relatively rigid at the centerline where the beam flange connects to the column flange at the web, thus causing the center portion of each of the upper and lower beam flanges to bear the greatest levels of stress and strain. It is believed that, with the stress and strain levels being non-linear across the beam to column connection, the effect of this non-linear characteristic can lead to failure in the connection initiating at the center point causing total failure of the connection. In addition, the effects of the state of stress described above are believed to promote brittle failure of the beam column or weld material.

To these ends, one aspect of the present invention includes use of vertically oriented reinforcing plates, or panels, disposed between the inner surfaces of the column flanges near the outer edges, on opposite sides, of the column web in the area where the upper and lower beam flanges connect to the column flange. The load or vertical panels alone create additional rigidity along the beam flange at the connection. This additional rigidity functions to provide more evenly distributed stresses and strains across the upper and lower beam flange connections to the column flange when under load. The rigidity of the vertical panels may be increased with the addition of a pair of horizontal panels, one on each side of the column web, and each connecting between the horizontal centerline of the respective vertical panels and the column web. With the addition of the panels, stresses and strains across the beam flanges are more evenly distributed; however, the rigidity of the column along its web, even with the vertical panels in place, still results in higher stresses and strains at the center of the beam flanges than at the outer edges of the beam flanges when under load.

Furthermore, as another aspect of the present invention, it has been discovered that a slot, preferably oriented generally vertical, cut into, and, preferably, completely through the column web, in the area proximate to where each beam flange connects to the column flange, reduces the rigidity of the column web in the region near where the beam flanges are joined to the column. The column slot includes, preferably two end, or terminus holes, joined by a vertical cut through the column with the slot tangentially connecting to the holes at the hole periphery closest to the column flange connected to the beam. The slot through the column web reduces the rigidity of the center portion of the column flange and thus reduces the magnitude of the stress applied at the center of the beam at the column flange connection.

As yet another aspect of the present invention, it has been discovered that, preferably, slots cut into and through the beam web in the area proximate to where both beam flanges connect to the column flange, further reduces the effects of the rigidity of the column web in the region where the beam flanges are joined to the column. The beam slots preferably extend from the end of the beam at the connection point to an end, or terminus hole, in the beam web, or alternatively may be positioned entirely within the beam so that the beam web surrounds the slot at both ends, top and bottom. The beam slots are generally horizontally displaced, although they may be inclined. Preferably, one slot is positioned underneath, adjacent and parallel to the upper beam flange, and a second beam slot is positioned above, adjacent and parallel to the lower beam flange. The beam slots are located just outside of the flange web fillet area and in the web of the beam.

In accordance with conventional practice, it is also desirable to construct, or retrofit, steel frame structures such that the plastic hinge point of the beam will be further away from the beam to column connection than would occur in a conventional beam-to-flange connection structure. In accordance with this practice, it has also been discovered that, preferably, use of upper and lower double beam slots accomplishes this result. The first upper and lower beam slots are as described above and may also be referred to as column adjacent slots. For each first beam slot, a second beam slot, each also generally a horizontally oriented slot is cut through the web of the beam and is entirely within the web. Each second beam slot is also positioned along the same center line as its corresponding first beam slot which terminates at the beam to column connection. It is preferred that each second beam slot have a length of approximately twice the length of its adjacent first beam slot, and be separated from its adjacent first beam slot by a distance approximately equal to the length of the first beam slot. These beam web interior beam slots also may be used without the column adjacent beam slots. In this alternate embodiment a predetermined length of beam web separates the end of the beam, with or without a weld access hole, from the end of the beam slot closest to the column flange. The slots may vary in shape, and in their orientation, depending on the analysis results for a particular joint configuration.

The first beam slots and/or the second beam slots, when positioned horizontally in the beam web near the upper and lower beam flanges, allow the beam web and beam flanges to buckle independently, that is, when the beam is subjected to its buckling load, the compression flange of the beam buckles out of its horizontal plane and the web of the beam buckles out of its vertical plane when the beam, as part of a structural frame, is subjected to cyclic or earthquake loadings. These first beam slots and/or second beam slots, of predetermined length when positioned horizontally in the beam web near the beam flanges, also eliminate or reduce the lateral-torsional mode of beam buckling which would result in reduced beam moment capacity. Because they eliminate the lateral-torsional mode of buckling, lateral beam flange braces are not required to insure full plastic beam moment capacity when the beam, as part of a structural frame, is subjected to cyclic or earthquake loadings.

With respect to the second, or interior horizontal beam web slots, they may be incorporated into the frame without the first beam slots, and in the beam web near the compression flange and at a predetermined distance away from the beam to column connection. Use of these beam slots of predetermined length alone can also reduce the moment capacity of the beam from its full moment capacity by allowing the beam compression flange and beam web to buckle independently out of their horizontal and vertical planes, respectively.

And yet another aspect of the present invention, it has also been discovered that the vertical shear force in the beam flanges is very significantly reduced when horizontal beam web slots are located near the end of the beam and near the beam flanges.

As yet another aspect of the present invention, it has also been discovered that the column slots and/or beam slots of the present invention may be incorporated in structures that include not only the vertically oriented reinforcing plates as described above, but also with structures that include conventional continuity plates, or column-web stiffeners. When used in conjunction with conventional continuity plates, or column-web stiffeners, the generally vertically oriented column slots are positioned in the web of the column, such that the first slot extends vertically from a first terminus hole located above and adjacent to the continuity plate which is adjacent and co-planar to, that is, provides continuity to the upper beam flange, and terminates in a second terminus hole in the column web. A second column slot extends vertically downward from the continuity plate adjacent and co-planar to, that is, providing continuity with, the lower beam flange. In this aspect of the present invention, horizontally extending beam slots, whether single beam slots or double beam slots of the present invention, may also be used with steel frame structures that employ conventional continuity plates.

As yet another aspect of the present invention, it has also been discovered that, in conjunction with the horizontal beam slots of the present invention, the conventional shear plate may be extended in length to accommodate up to three columns of bolts, with conventional separation between bolts. The combination of the upper and/or lower horizontal beam slots and the conventional and/or lengthened shear plates may be used in conjunction with top down welding techniques, bottom up welding techniques or down hand welding techniques.

The present invention vertical plates with, or without, the slots of the present invention, or, the slots with, or without, vertical plates provide for beam to column connections which generally more evenly distribute, and reduce the maximum magnitude of, the stress and strain and stress and strain rate experienced in the beam flanges across a connection in a steel frame structure than are experienced in a conventional beam to column connection during seismic loading.

BRIEF DESCRIPTION OF DRAWINGS

The objects and advantages of the present invention will become more readily apparent to those of ordinary skilled in the art after reviewing the following detailed description and accompanying documents wherein.

DETAILED DESCRIPTION OF PREFERRED EMBODIMENTS

Referring to the Figures, especially 1–4, 9–15, and 22–23, the skeleton steel frame used for seismic structural support in the construction of buildings in general frequently comprises a rigid or moment, steel framework of columns and beams connected at a connection. The connection of the beams to the columns may be accomplished by any conventional technique such as bolting, electric arc welding or by a combination of bolting and electric arc welding techniques.

Figure 22:
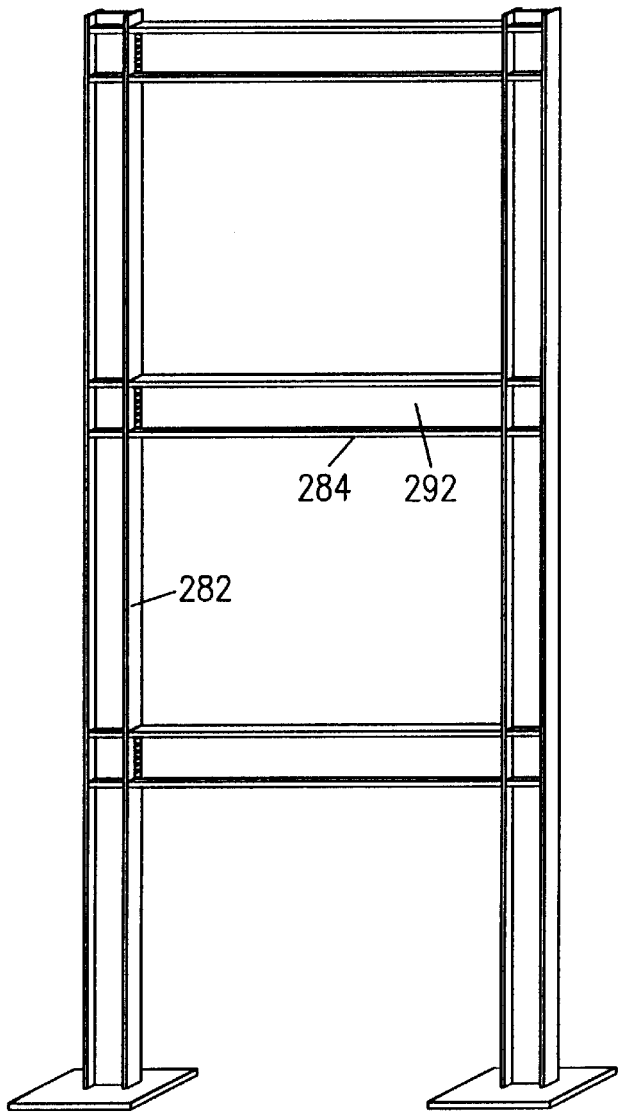
FIG. 22 is a perspective view of a conventional steel moment resisting frame.
Figure 23:
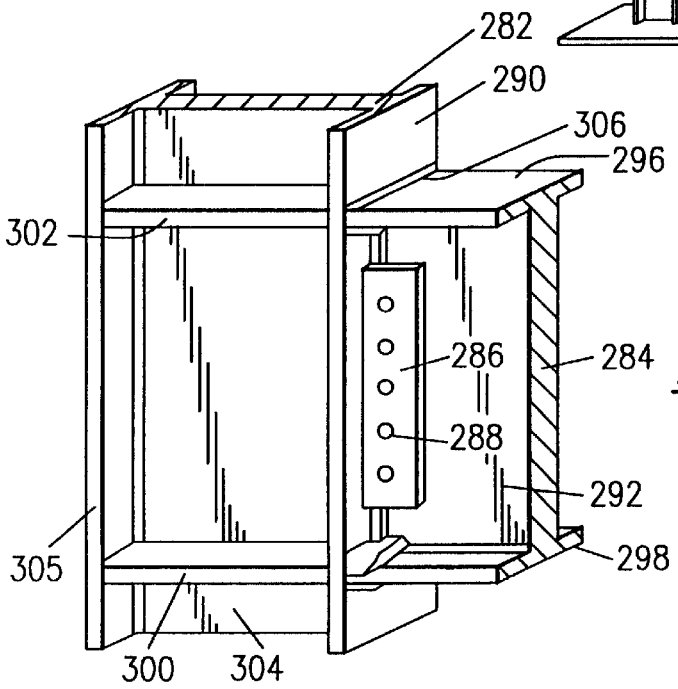
FIG. 23 is an enlarged, detailed perspective view of a conventional beam to column connection.

Referring to FIGS. 22 and 23, a conventional W 14×176 (360×262) column 282 and a W 27×94 (690×140) beam 284 are conventionally joined by shear plate 286 and bolts 288 and welded at the flanges. The parenthetical notation is the beam or column size expressed in metric units. The column 282 includes bolt shear plate 286 welded at a lengthwise edge along the lengthwise face of the column flange 290. The shear plate 286 is made to be disposed against opposite faces of the beam web 292 between the upper and lower flanges 296 and 298. The shear plate 286 and web 292 include a plurality of pre-drilled holes. Bolts 288 inserted through the pre-drilled holes secure the beam web between the shear plate. Once the beam web 292 is secured by bolting, the ends of the beam flanges 296 and 298 are welded to the face of the column flange 290. Frequently, horizontal stiffeners, or continuity plates 300 and 302 are required and are welded to column web 304 and column flanges 290 and 305. It has been discovered that, under seismic impact loading, region 306 of a beam to column welded connection experiences stress concentration factors in the order of 4.5–5.0. Additionally, it has been discovered that non-uniform strains and strain rates exist when such connections are subjected to seismic or impact loadings. These nonuniformities are associated primarily with the geometry and stiffness of the conventional connection.

Column Load Plates, Support Plates And Slot Features of the Present Invention

Figure 1:
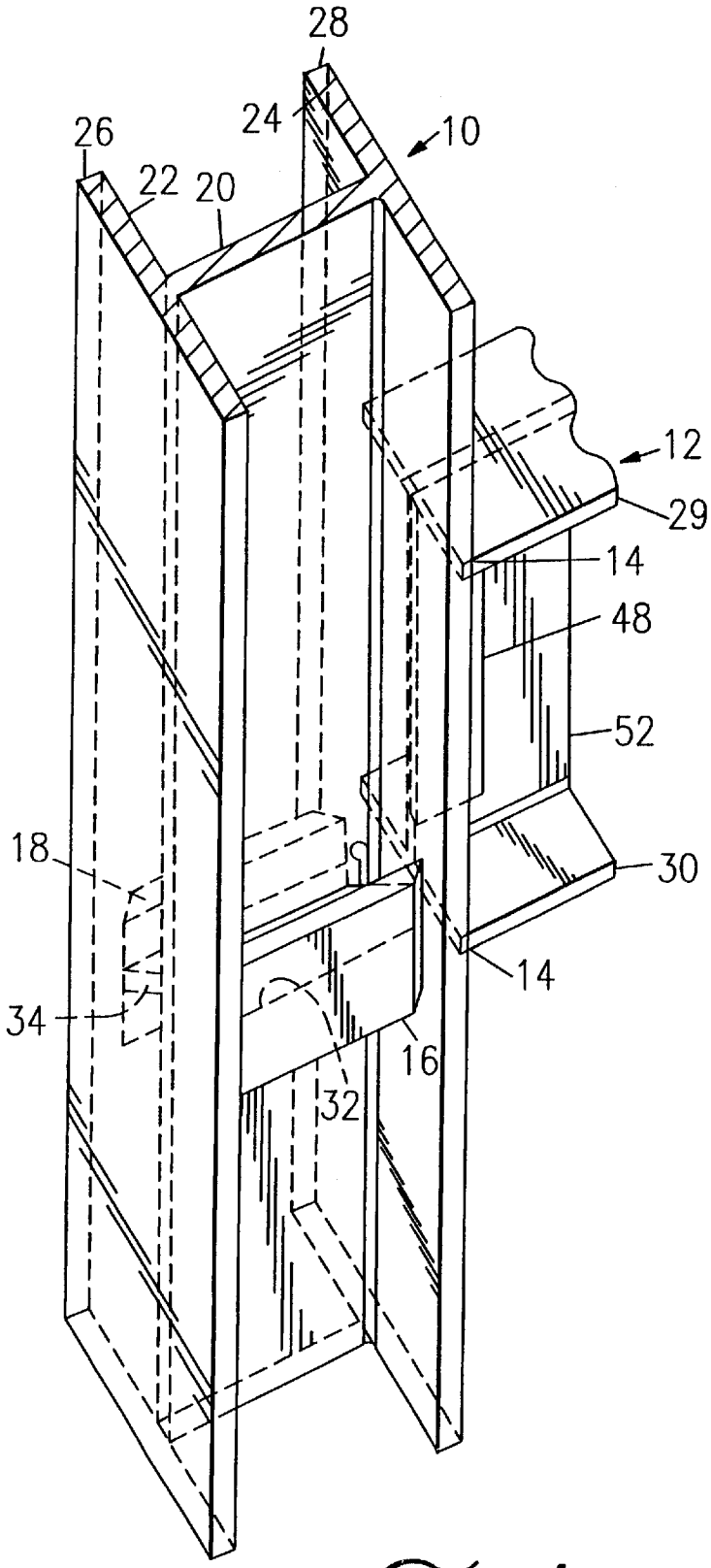
FIG. 1 is a perspective view of a first preferred embodiment of the present invention.
Figure 2:
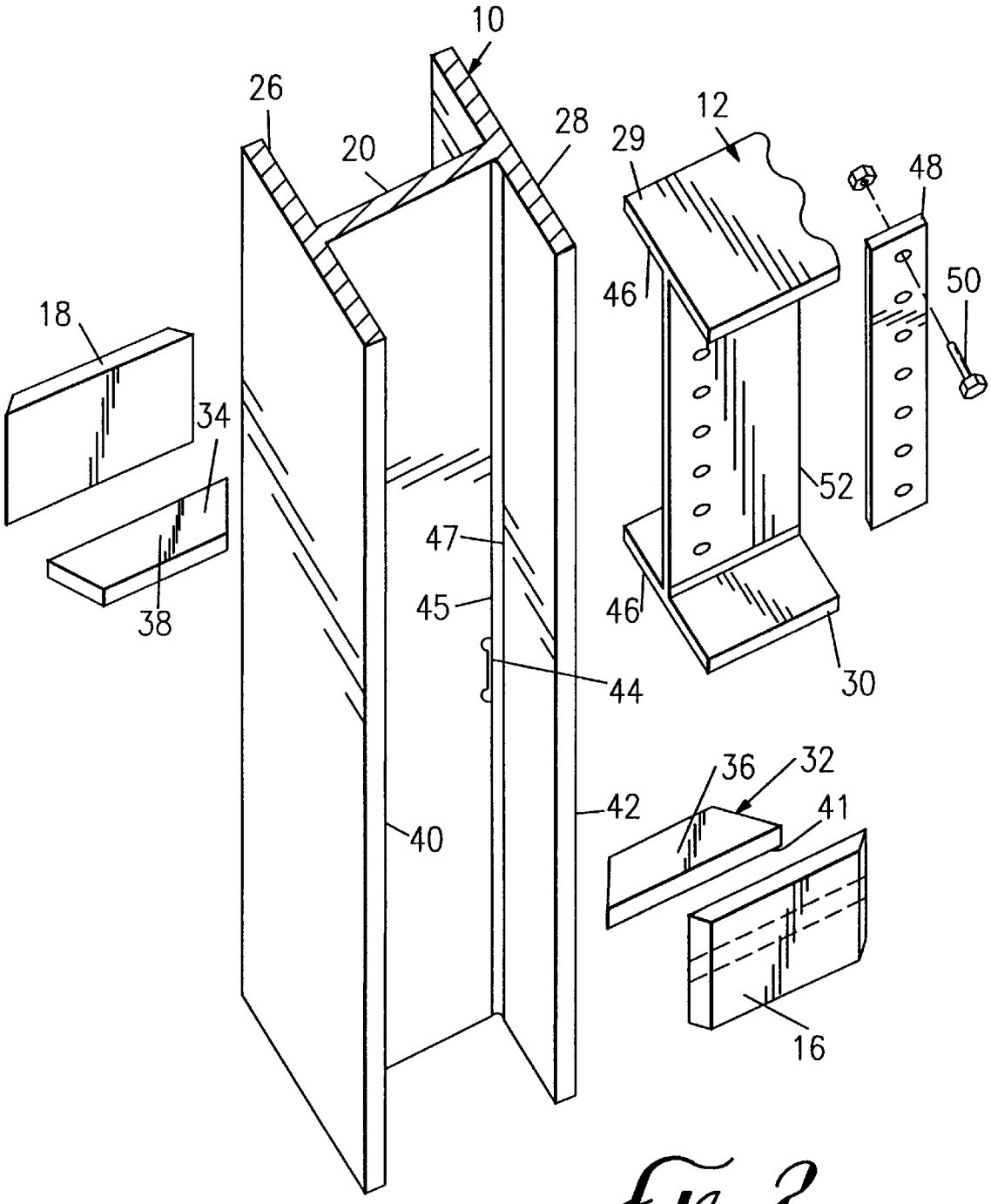
FIG. 2 is an exploded view of the connection for supporting dynamic loading of FIG. 1.
Figure 3:
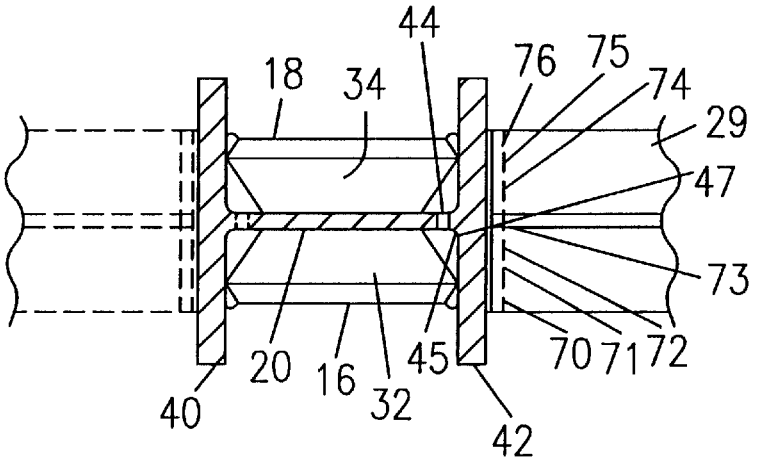
FIG. 3 is a top view of the connection for supporting dynamic loading of FIG. 1.
Figure 4:
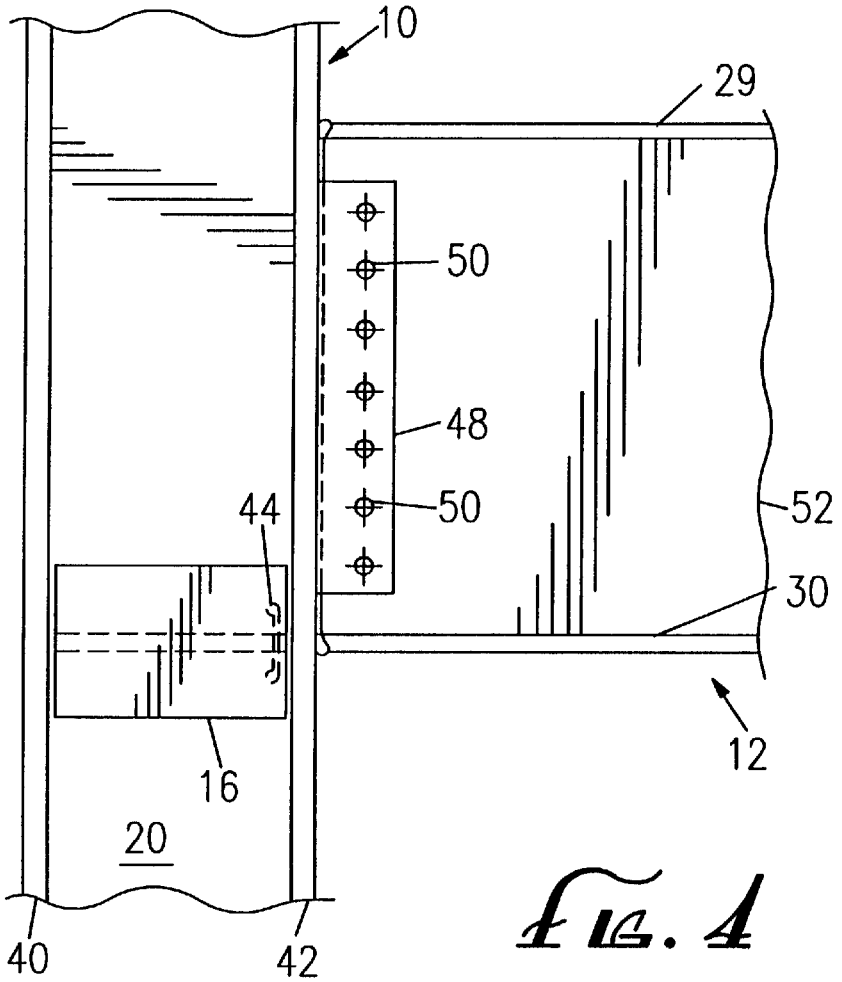
FIG. 4 is a side view of the connection for supporting dynamic loading of the present invention of FIG. 1.

Referring to FIGS. 1–2, in a first preferred embodiment, for asserting and maintaining the structural support of the connection under static, impact or dynamic loading conditions, such as during an earthquake, a pair of load plates 16 and 18 are provided disposed lengthwise on opposite sides of the column web 20 of column 10 between the inner faces 22 and 24 of the column flanges 26 and 28 and welded thereto within the zone where the beam flanges 29 and 30 of beam 12 contact the column flange 28. Respective horizontal plates 32 and 34 are positioned along the lengthwise centerline of the vertical plates 16 and 18, respectively, and connected to the vertical plates 16 and 18, respectively, and the web 20, for added structural support. The support plate surfaces 36 and 38 are, preferably, trapezoidal in shape. Plate 36 has a base edge 41 extending along the lengthwise centerline of the load plate 16, and a relatively narrow top which is welded along and to the web 20. The vertical plates 16 and 18 are preferably positioned along a plane parallel to the web 20 but at a distance from web 20 less than the distance to the respective edges of the column flanges 40 and 42. The preferred distance is such that the rigidity of the column flange is dissipated across its width in the zone where the beam flanges 29 and 30 are connected to the column 10. The horizontal and vertical support plates are, preferably, made of the same material as the column to which they are connected.

Figure 7:
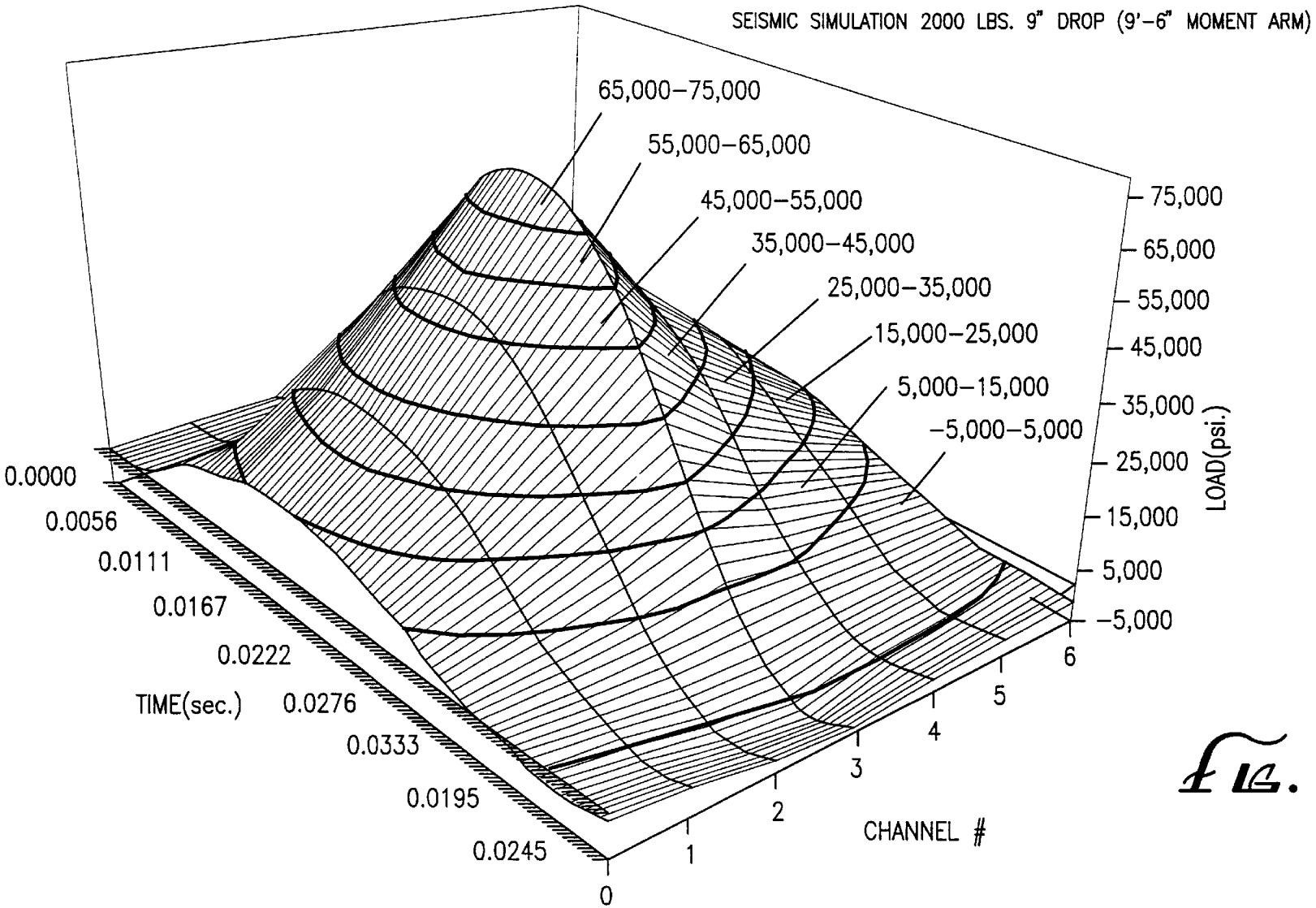
FIG. 7 is a three dimensional depiction of the graph shown in FIG. 5.
Figure 8:
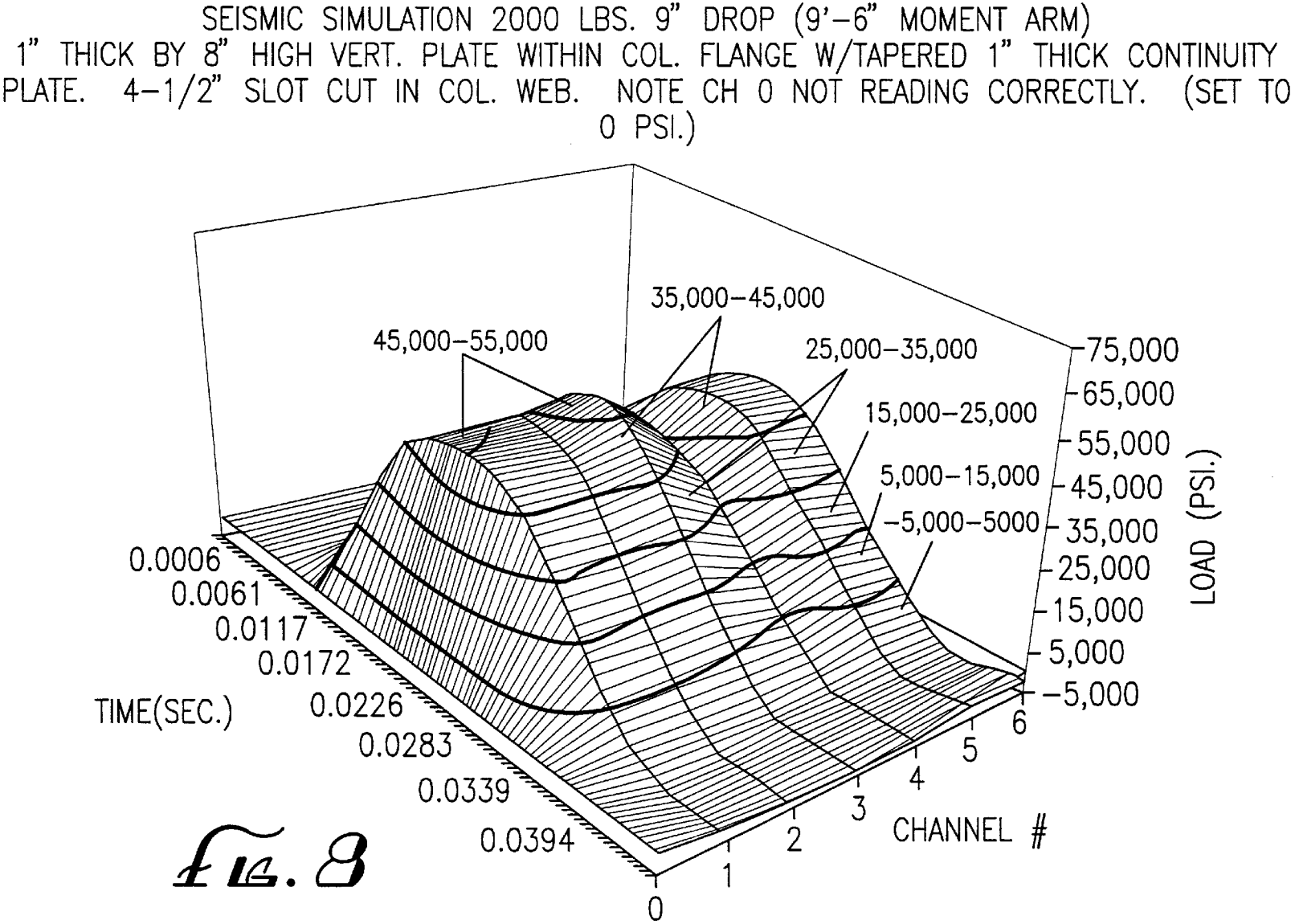
FIG. 8 is a three dimensional depiction of the graph shown in FIG. 6.

Experiments have shown that the load plates 16 and 18, by increasing rigidity, function to help average the stresses and strain rates across the beam flanges 29 and 30 at the connections and decrease the magnitude of stress measured across the beam flanges 29 and 30, but do not significantly reduce the magnitude of the stress levels experienced at the center region of the beam flange. The load or column flange stiffener plates 16 and 18 alone, by creating near uniform stress in the connection function adequately to help to reduce fracture at the connection. However, it is also desirable to reduce the magnitude of stress measured at the center of the beam flanges 29 and 30 and that stress may be further reduced by use of a slot 44. The column web slot 44, cut longitudinally, is useful at a length range of 5 per cent to 25 per cent of beam depth cut at or near the toe 45 of the column fillet 47 within the column web 20 centered within the zone where the beam flanges 29 and 30 are attached proximate to the connection. The term "beam depth" is used in its conventional sense, and means the total height of the beam. The slot 44 serves to reduce the rigidity of the column flange 42 and allows the column flange 28 center to flex, thereby reducing the magnitude of stress in the center of the beam flanges. The vertical plates 16 and 18 with or without the web slot 44 function to average out the magnitude of stress measured across the beam connection 14. By equalizing, as much as possible, the stress and strain distributions along the beam flanges 29 and 30, the stress variances within the beam 12 are minimized at the connection. In addition, a thus constructed connection 14 evenly distributes the magnitude of stress across the weld to ensure that the connection 14 does not fracture across the column flange 28 during static, impact or dynamic loading conditions. As shown in FIG. 8, when the load plates 16 and 18 and slot 44 are incorporated in the structure at column 10 proximate to the connection 14, strain rates measured across the beam flanges 29 and 30 appear more evenly distributed, and the magnitude of stress across the beam flange edge 46, has a substantially reduced variation across the beam in comparison to the variation shown in FIG. 7. The measurements were taken at seven points, or channels width-wise across the beam flange.

In a preferred embodiment, shown in FIGS. 1–2, a conventional W 14×176 (360×262) column 10 and a W 27×94 (690×140) beam 12 are conventionally joined by mounting plate 48 and bolts 50 and welded at the flanges. The column 10 includes shear connector plate 48 welded at a lengthwise edge along the lengthwise face of the column flange 28. The mounting plate 48 is made to be disposed against opposite faces of the beam web 52 between the upper and lower flanges 29 and 30. The mounting plate 48 and web 52 include a plurality of pre-drilled holes. Bolts 50 inserted through the pre-drilled holes secure the beam web between the mounting plates. Once the beam web 52 is secured by bolting, the ends of the beam flanges 29 and 30 are welded to the face of the column flange 28. The combination of the bolt and welding at the connection rigidly secures the beam 12 and column 10 to provide structural support under the stress and strain of static and dynamic loading conditions. In the preferred embodiment the shear connector plate 48 is also welded to the column flange 28.

Figure 5:
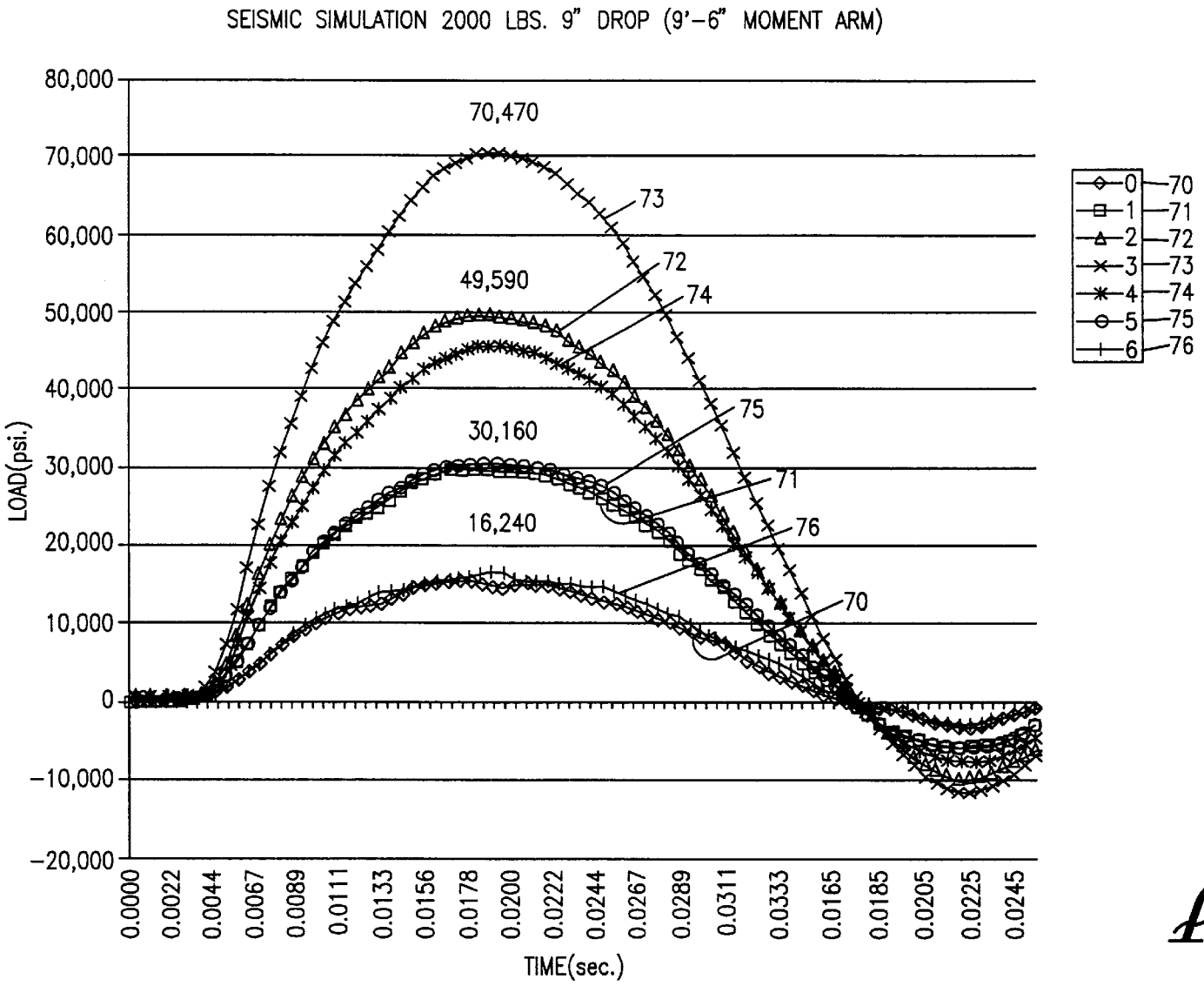
FIG. 5 is a graph of the stress, determined from strain gages, as a function of time caused by dynamic loading in a conventional connection.
Figure 6:
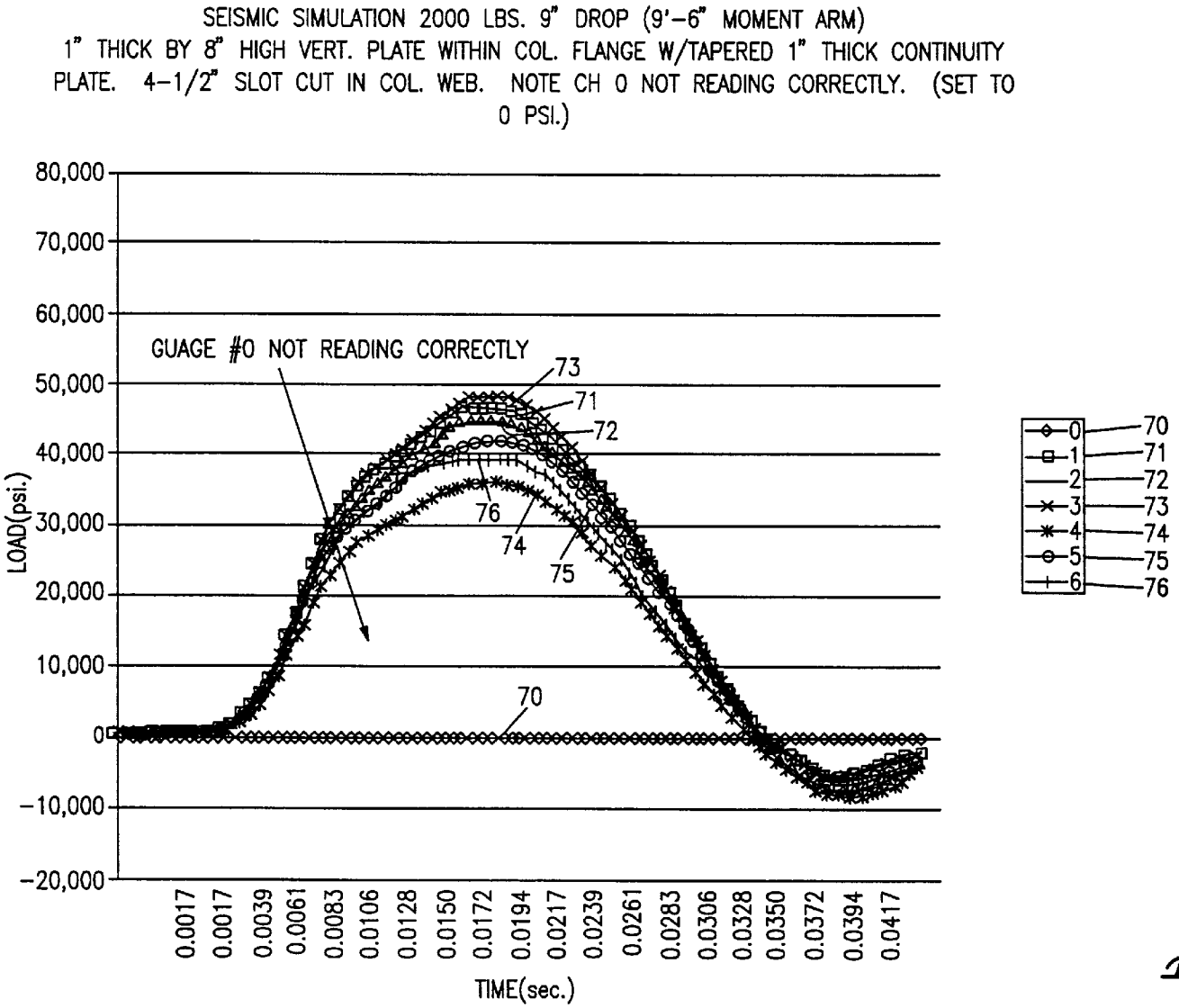
FIG. 6 is a graph of the stress, determined from strain gages, as a function of time caused by dynamic loading in the connection of FIG. 1.
Figure 24:
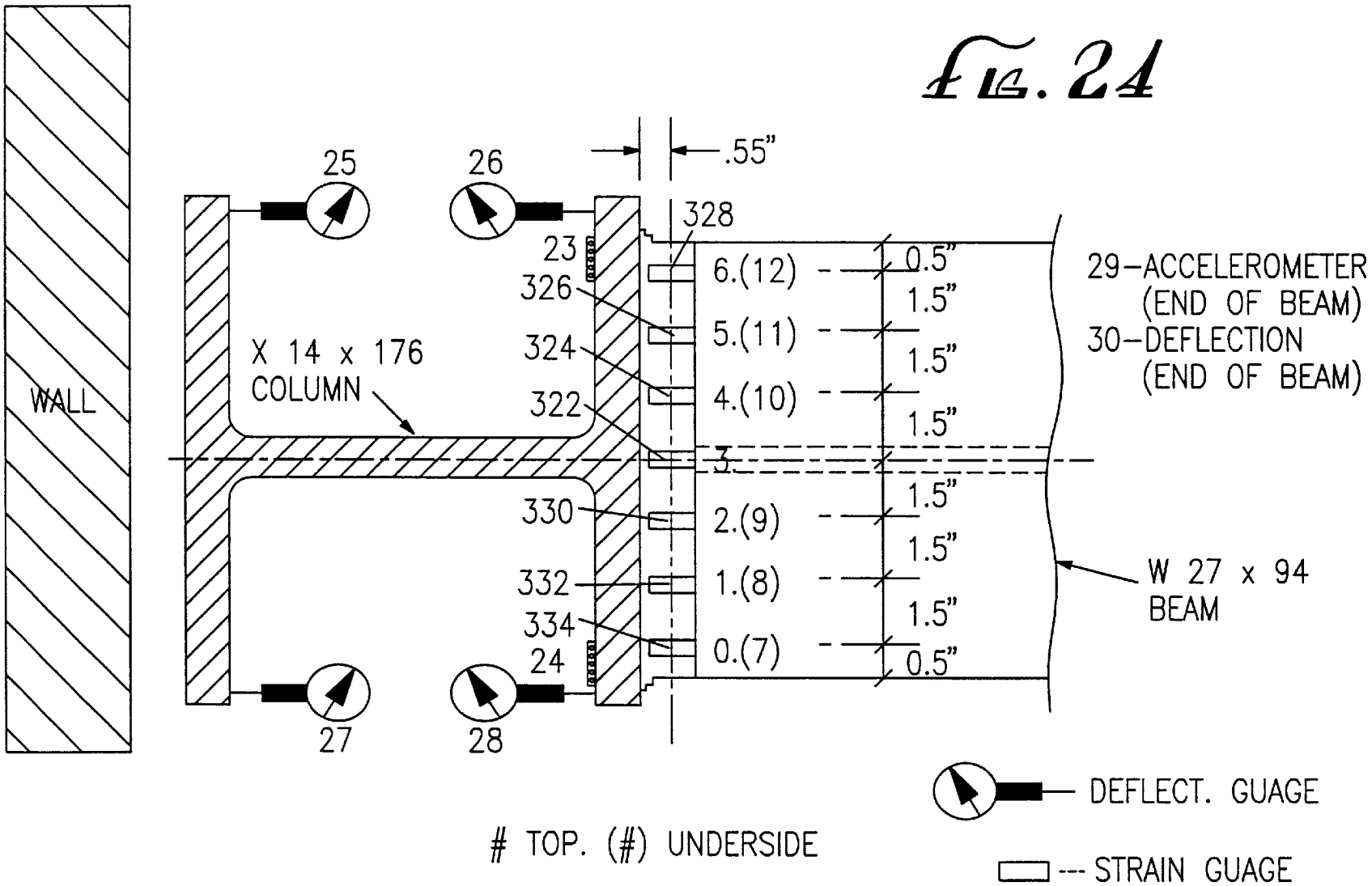
FIG. 24 is a side view of a beam to column connection illustrating location of strain measurement devices.

For purposes of this invention, stress is defined as the intensity of force per unit area and strain is defined as elongation per unit length. As shown in FIGS. 5 and 6, in a seismic simulation of loading, stresses were measured as a function of strains at seven equidistant points, or channels 70–76 width-wise across the beam flange in psi during the dynamic loading. These results show a significantly greater stress magnitude measured at the center 73 of the beam flange. In addition, the different slopes of the increasing stress levels shown in FIGS. 7–8 represent uneven distributon of strain at different points 70–76 along the beam flange. FIG. 24 shows the exact location of the strain measurement devices, i.e., the points or channels, in relation to the center line of the column. As the measurements are taken further away from the center 73 of the column flange along the beam flange edge, the levels of stress are shown to be reduced significantly at each pair of measurement points 72 and 74, 71 and 75, 70 and 76, i.e., as the distance extends outward on the beam flange away from the center. The results show that the beam flange 29 at the connection 14 experiences both the greatest level of the stress and the greatest level of strain at the center of the beam web to column flange connection at the centerline of the column web. The connection 14 configuration represents the zone of either or both the upper 29 and lower 30 beam flange. The column web slot 44 cut lengthwise in the column web 20 centered within the zone of the lower beam flange connection 30 is generally about ¾ of an inch (1.905 cm) from the inner face of the column flange near the beam flange connection. In the preferred embodiment, slot widths in the range of 4 to 8 inches (10.16 cm to 20.32 cm) in length are preferred. The best results at ¾ of an inch (1.905 cm) from the flange were achieved using a 4.5 inch (11.43 cm) length slot with a 0.25 inch (0.635 cm) width. Slots longer than eight inches (20.32 cm) may also be useful. Those skilled in the art will appreciate that the specific configurations and dimensions of the preferred embodiment may be varied to suit a particular application, depending upon the column and beam sizes used in accordance with the test results.

The load plates 16 and 18 and the respective support plates 32 and 34 are preferably made from a cut-out portion of a conventional girder section. The load plates comprising the flange surface and the support plates comprising the web of the cut-out portions. Alternatively, a separate load plate welded to a support plate by a partial penetration weld, with thicknesses adequate to function as described herein, would perform adequately as well. The horizontal plates 32 and 34, preferably, do not contact the column flange 28 because such contact would result in an increased column flange stiffness and as a consequence increased stress at that location, during dynamic loading such as occurs during an earthquake. Each support plate base 41 preferably extends lengthwise along the centerline of the respective load plates 16 and 18 to increase the rigidity of the load plate and is tapered to a narrower top edge welded width-wise across the column web 20. The, preferably, trapezoidal shape of the support plates surface provides gaps between the respective column flanges and the edges of the support plates. Such gaps establish an adequate open area for the flange to flex as a result of the slot 44 formed in the web within the gap areas.

Figure 9:
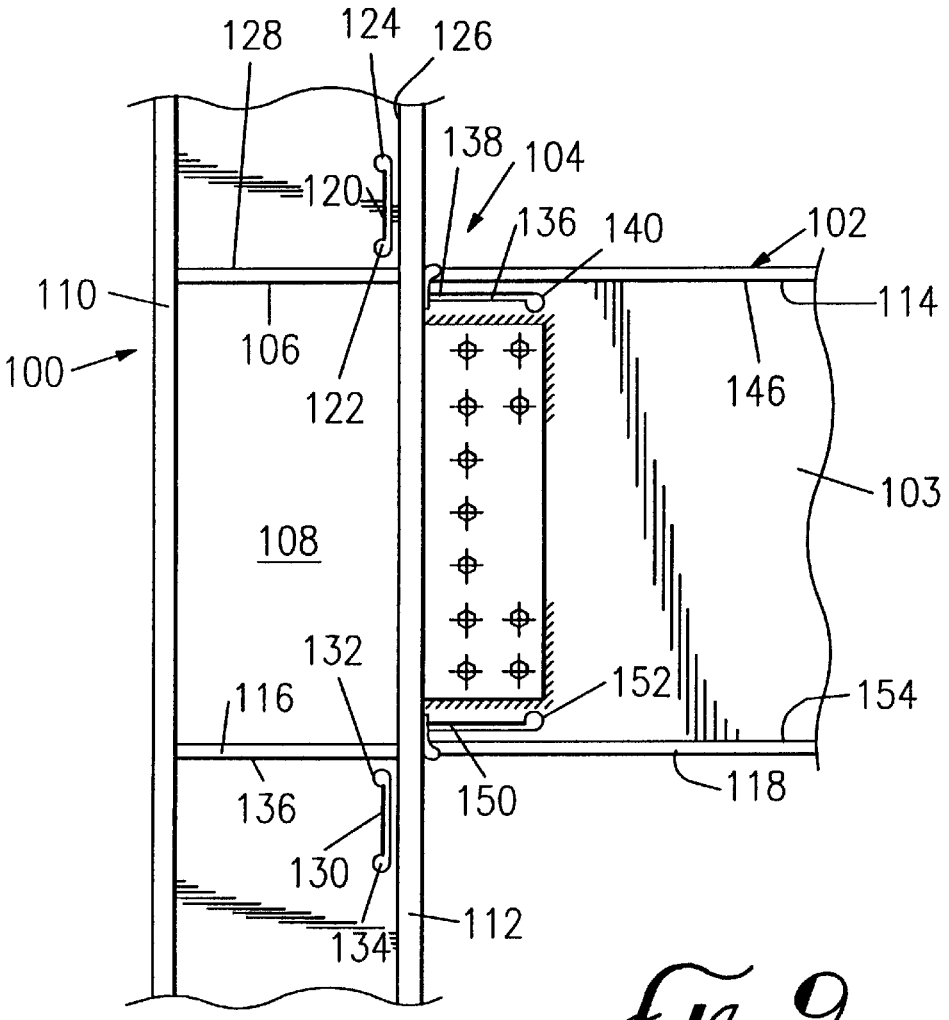
FIG. 9 is a side view of another preferred embodiment of the present invention including a column and beam connection, a conventional continuity plate, and vertical column slots and upper and lower beam slots of the present invention.
Figure 10:
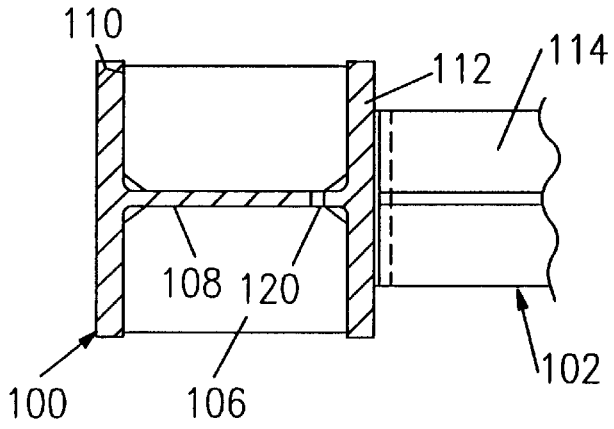
FIG. 10 is a top view of the FIG. 9 embodiment.

Column Slots With Conventional Column Continuity Plates Features of the Present Invention Referring to FIG. 9, column 100 is shown connected to beam 102 at connection 104, as described above. Upper conventional continuity plate, also commonly referred to as a stiffener, or column stiffener, 106 extends horizontally across web 108 of column 100 from left column flange 110 to right column flange 112. Plate 106 is co-planar with upper beam flange 114, is made of the same material as the column, and is approximately the same thickness as the beam flanges. Referring to the FIG. 10 top view, column 100, beam 102, column web 108 and top beam flange 114 are shown. Continuity plate 106, left and right column flanges 110 and 112 are also shown.

Again referring to FIG. 9, lower continuity plate 116 is shown to be co-planar with lower beam flange 118. Upper column slot 120 is shown extending through the thickness of column web 108, and is, preferably, vertically oriented along the inside of right column flange 112. The lower end, or lower terminus 122 of the slot 120, and the upper terminus 124 are holes, preferably drilled. In the case when the column is a W 14×176 inch (360×262) steel column, the holes 122, 124 are preferably ¾ inch (1.905 cm) drilled holes, and the slot is ¼ inch (0.635 cm) in height and cut completely through the web. When connected to a W 27×94 (690×140) steel beam, the preferred length of slot 120 is 6 inches (15.24 cm) between the centers of holes 122 and 124 and are tangential to the holes 122 and 124 at the periphery of the holes closest to the flange. The centers of holes 122 and 124 are also, preferably, ¾ inch (1.905 cm) from the inner face 126 of right column flange 112. The center of hole 122 is, preferably, 1 inch from the upper continuity plate 106. Positioned below lower continuity plate 116 is lower column slot 130, with upper and lower terminus holes 132 and 134, respectively. Lower column slot 130 preferably has the same dimension as upper column slot 120. Lower slot 130 is positioned in web 108, the lower face 136 of lower continuity plate 116, right column flange 112 and lower beam flange 118 in the same relative position as upper slot 120 is positioned with respect to continuity plate 106 and upper beam flange 114. The holes may vary in diameter depending on particular design application.

Beam Slots Features of the Present Invention

Figure 11:
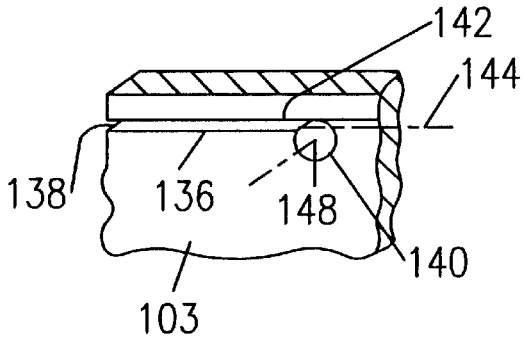
FIG. 11 is a detailed, perspective view of the upper, horizontal beam slot of the FIG. 9 embodiment.
Figure 12:
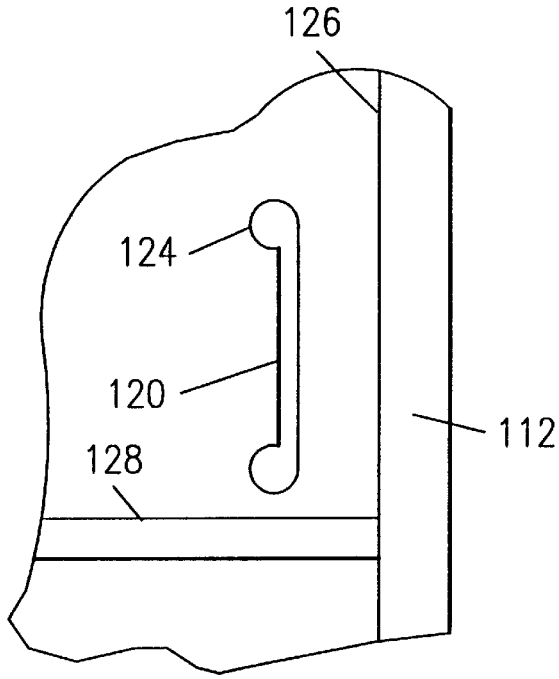
FIG. 12 is a detailed view of a column slot of the FIG. 9 embodiment.

Also referring to FIG. 9, a beam slot feature of the present invention is shown. Upper beam slot 136, shown in greater detail in FIG. 11, is shown as cut through the beam web and as extending in a direction generally horizontal and parallel to upper beam flange 114. A first end 138 of the beam slot, shown as a left end terminates at the column flange 112. The slot, for a typical W 27×94 (690×140) steel beam, is preferably ¼ inch (0.635 cm) wide and is cut through the entire thickness of beam web 103. The second terminus 140 of the upper horizontal beam slot is a hole, preferably, 1 inch (2.54 cm) in diameter in the preferred embodiment. The center of the hole is positioned such that the upper edge 142 of the slot 136 is tangential to the hole, as more clearly shown in FIG. 11. Also, for a W 27×94 (690×140) steel beam, the center line 144 of the slot 136 is ⅜ inch (0.9525 cm) from the lower surface 146 of the upper beam flange 114, with the center 148 of the hole being 1⅞ inches (4.7625 cm) from the beam flange surface. The preferred slot length for this embodiment is 15 inches (38.10 cm). Referring to FIG. 9, lower, horizontally extending beam slot 150 is shown. The lower beam slot 150 is tangential to the bottom of the corresponding terminus hole 152, and the dimensions of the slot and hole are the same as those for the upper beam slot. The lower beam slot 150 is positioned relative to the upper surface 154 of the lower beam flange 118 by the same dimensions as the upper beam slot 136 is positioned from the lower surface 146 of the upper beam flange 114. As is well known, welding of the beam to the column is facilitated by use of conventional weld access holes, defined and described in the Manual Of Steel Construction Allowable Stress Design, American Institute Of Steel Construction, Inc., 9th Ed., 1989, Chapter J, Connections, Joints And Fasteners, pages 5–161 through 5–163. As is readily apparent from the present disclosure, the beam slot feature of the present invention is longer than a weld access hole, and has a different function. A beam slot may be incorporated into a beam so that it also performs the function of a weld access hole, by placing first end 138 of the beam slot so that it terminates in the corner of the connection, rather than ⅜ inch below the lower surface 146 of the upper flange 114. Conventional weld access holes, however, cannot perform the functions of a beam slot of the present invention, due primarily to the absence of a length sufficient to produce the intended stress and strain reduction, stress and strain rate reduction, and the elimination of beam lateral torsion buckling mode.

Figure 13:
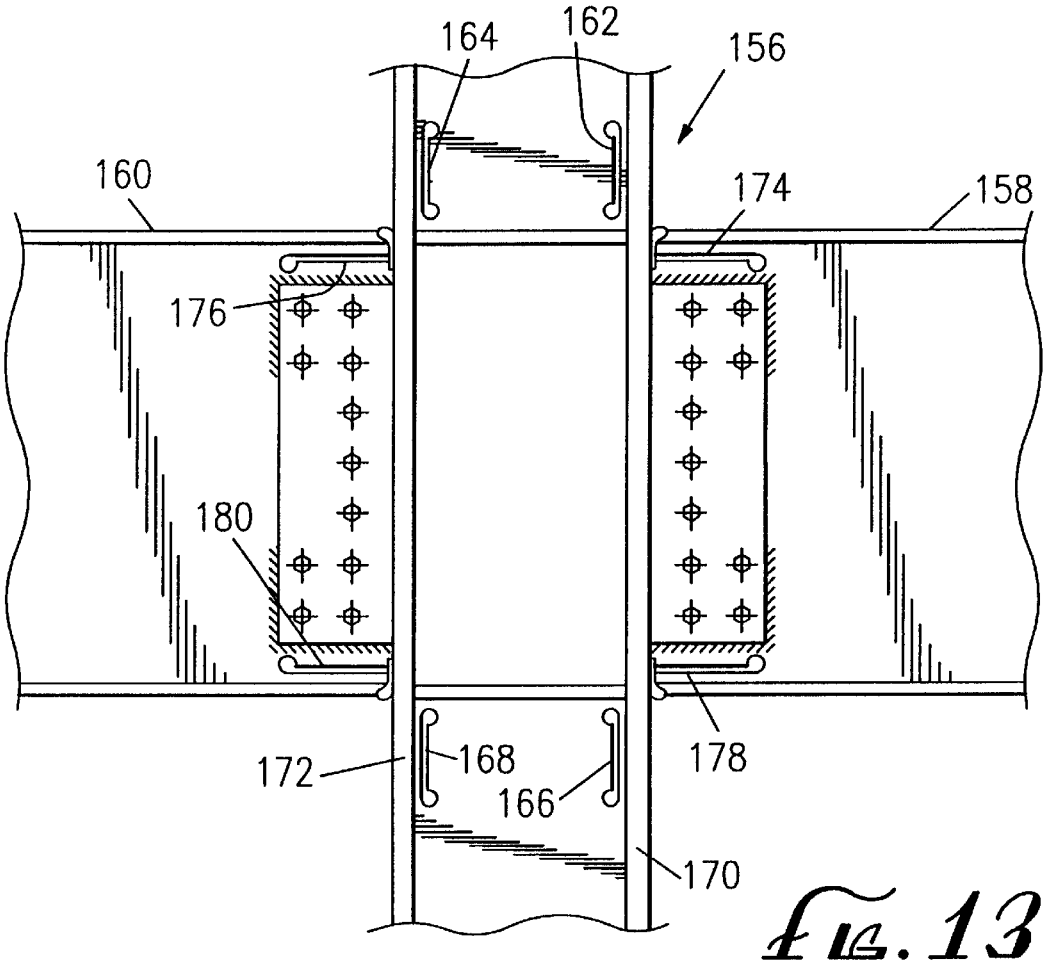
FIG. 13 is a side view of another preferred embodiment including a connection of two beams to a single column, upper and lower vertical column slots adjacent each of the two beams, and upper and lower horizontally extending beam slots for each of the two beams.

Referring to FIG. 13, a single column 156 having two connecting beams 158, 160 is shown. The column 156 includes upper column slots 162, 164 and lower column slots 166, 168, as described in greater detail above, adjacent to each of the column flanges 170, 172 connected to each of the two beams 158, 160. Also, each of the two beams is shown with upper beam slots 174, 176 and lower beams slots 178, 180 as described in greater detail above. The column and beam slots associated with the connection of beam 160 to column 156 are the mirror images of the slots associated with the connection of beam 158 to column 156, and have the dimensions as described in connection with FIGS. 9–12.

The slots may vary in orientation from vertical to horizontal and any angle in between. Orientation may also vary from slot to slot in a given application. Furthermore, the shape, or configuration of the slots may vary from linear slots as described herein to curvilinear shapes, depending on the particular application.

Single and/or Double Beam Slots Features of the Present Invention

Figure 14:
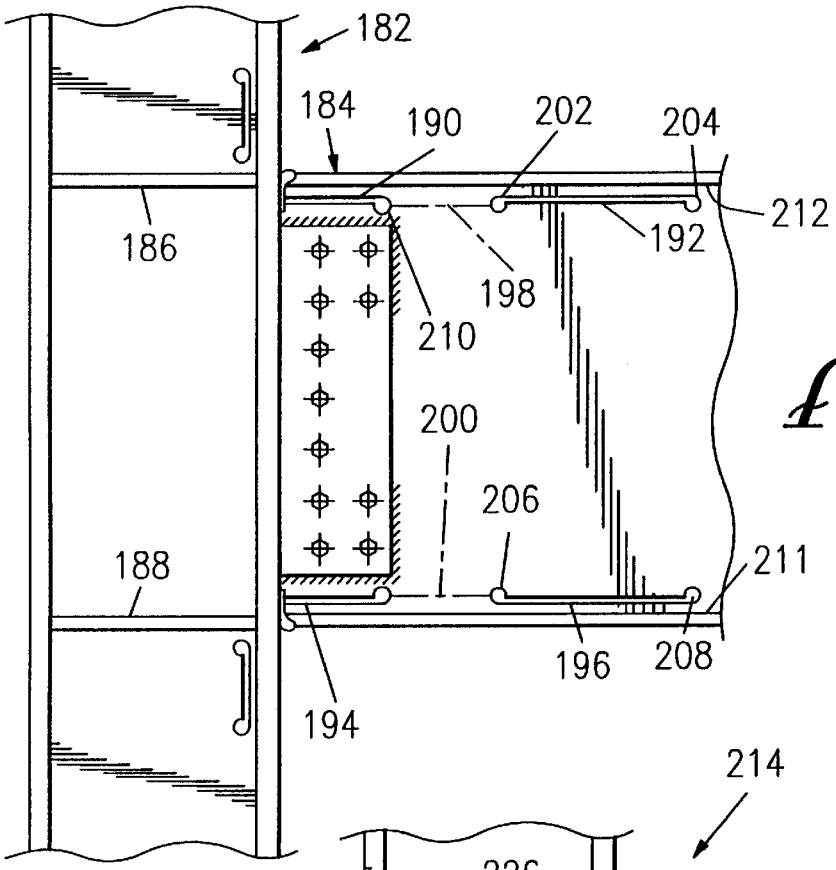
FIG. 14 is a side view of another preferred embodiment of the present invention including a column to beam connection with upper and lower, double beam slots and upper and lower vertically oriented column slots.
Figure 34:
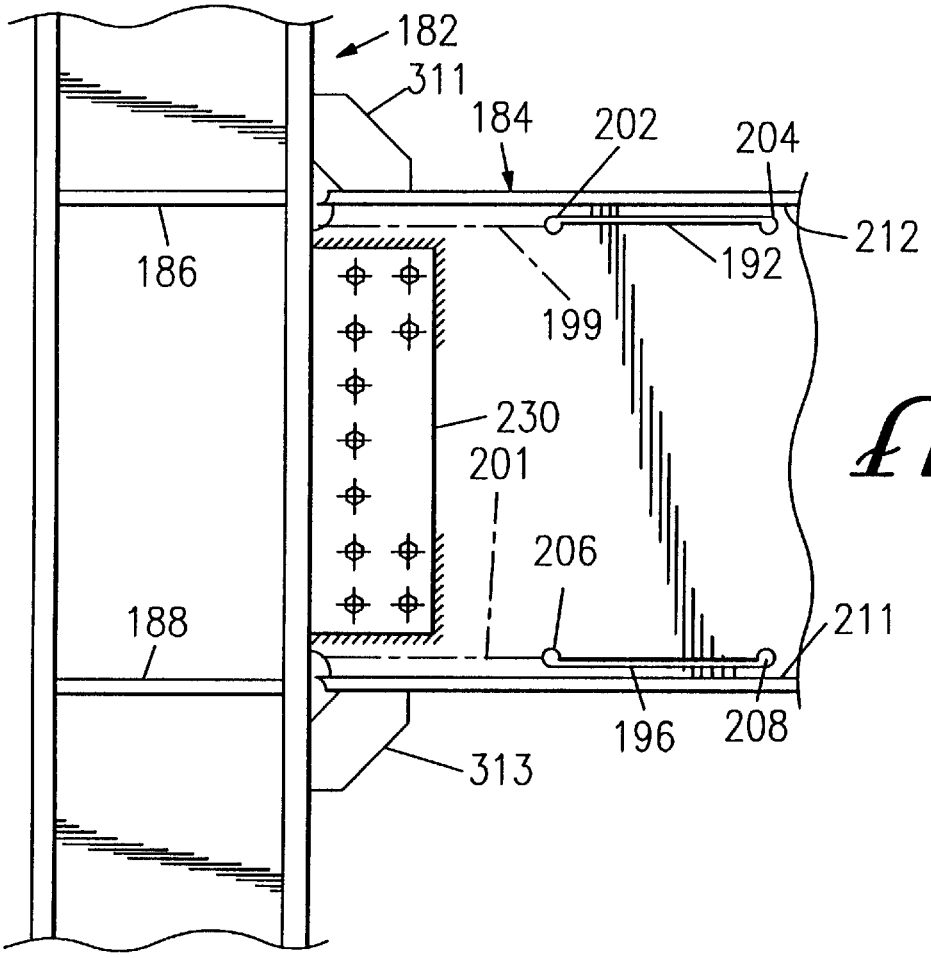
FIG. 34 is a side view of another preferred embodiment of the present invention including a beam to column connection with vertical fins and upper and lower beam web slots that are positioned away from the end of the beam.

In accordance with conventional practice, many regulatory and/or design approval authorities may require modification of the conventional beam to column connection such that the beam plastic hinge point is moved away from the column to beam connection further along the beam than it otherwise would be in a conventional connection. Typically the minimum distance many in this field consider to be an acceptable distance for the plastic hinge point to be from the connection would be between D/2 and D where D is the height of the beam. In accordance with the present invention, and as illustrated in FIG. 14, column 182 is shown with beam 184 and continuity plates 186, 188 as described above. Beam 184 has upper column adjacent beam slot 190; upper beam web interior beam slot 192; column adjacent lower beam slot 194; and lower beam web interior beam slot 196. The beam slots 190 and 194 immediately adjacent to the column 182 are described in greater detail above. When the interior slots 192 and 196 are used, the column adjacent slots 190 and 194 may be entirely eliminated, or reduced in length to serve as typical weld access holes. The center lines of the beam web interior beam slots 192, 196 are preferably horizontal, near the upper and lower beam flanges, respectively and surrounded by beam web above, below and at each end with a predetermined length of beam web separating the column flange, with or without a weld access hole, from the nearest end of the beam slot. The interior beam slots 192, 196 function to move the plastic hinge point further away from the beam to column connection with (FIG. 14), or without use of the column adjacent slots 190, 194 (FIG. 34). These interior beam slots 192, 196 have two terminus holes each, as shown at 202, 204, 206, 208, respectively. In a W 27×94 (W 690×140) steel beam the preferred length of each interior beam slot is 12 inches (30.48 cm) from terminus hole 202 center to hole 204 center, with 1 inch (2.54 cm) diameter terminus holes as shown in FIG. 14. Also, preferably, the center of the first terminus hole 202 of the interior, upper beam slot 192 is a distance 198 of 6 inches (15.24 cm) from the center of the terminus hole 210 of the column adjacent, upper beam slot 190. The centerlines of the terminus holes are co-linear with each other just outside the fillet area. Each beam web interior beam slot is cut just outside the fillet area of the flange, in the web, and the terminus holes are tangential to the slot, on the side of the holes closest to the nearest beam flange. The width of each beam web interior beam slot is, preferably, ¼ inch (0.635 cm) and extends through the entire thickness of the beam. Again referring to FIG. 14, beam web interior lower beam slot 196 is cut to be co-linear with the beam web interior lower beam slot 194. The beam slot 196 has dimensions, preferably, identical to the dimensions of the beam slot 192, and its position relative to the lower beam flange's upper surface 211 corresponds to the positioning of the beam slot 192 relative to the lower surface 212 of the upper beam flange.

Although not shown in FIG. 14, the column slots, load plates, and/or support plates as described above may be used with the double beam slots.

Referring to another alternate embodiment, shown in FIG. 34, the beam web interior slots 192, 196 with terminus holes 202, 204, 206, and 208 are shown without the column adjacent slots, and positioned predetermined distances 199, 201 away from the end of the beam. These slots also eliminate or reduce lateral-torsional buckling and/or the moment capacity of the beam when the beam is part of a structural frame that is subjected to cyclic or earthquake loadings and move the plastic hinge point away from the connection. In this preferred embodiment the distances 199 and 201 are equal and equal to or longer than the length of the shear plate 230. Also in this preferred embodiment, the length of the beam web interior slots 192, 196 should be at least equal to the web plastic hinge length shown in FIG. 33 and described below.

Figure 32:
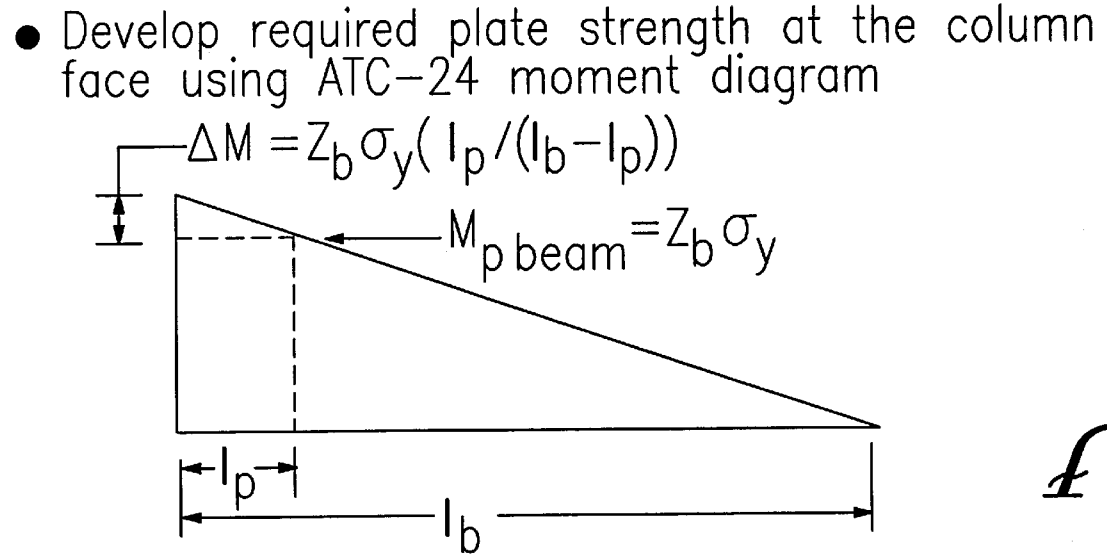
FIG. 32 is a diagram of the ATC-24 moment diagram annotated for design of shear plate thickness of the present invention.
Figure 33:
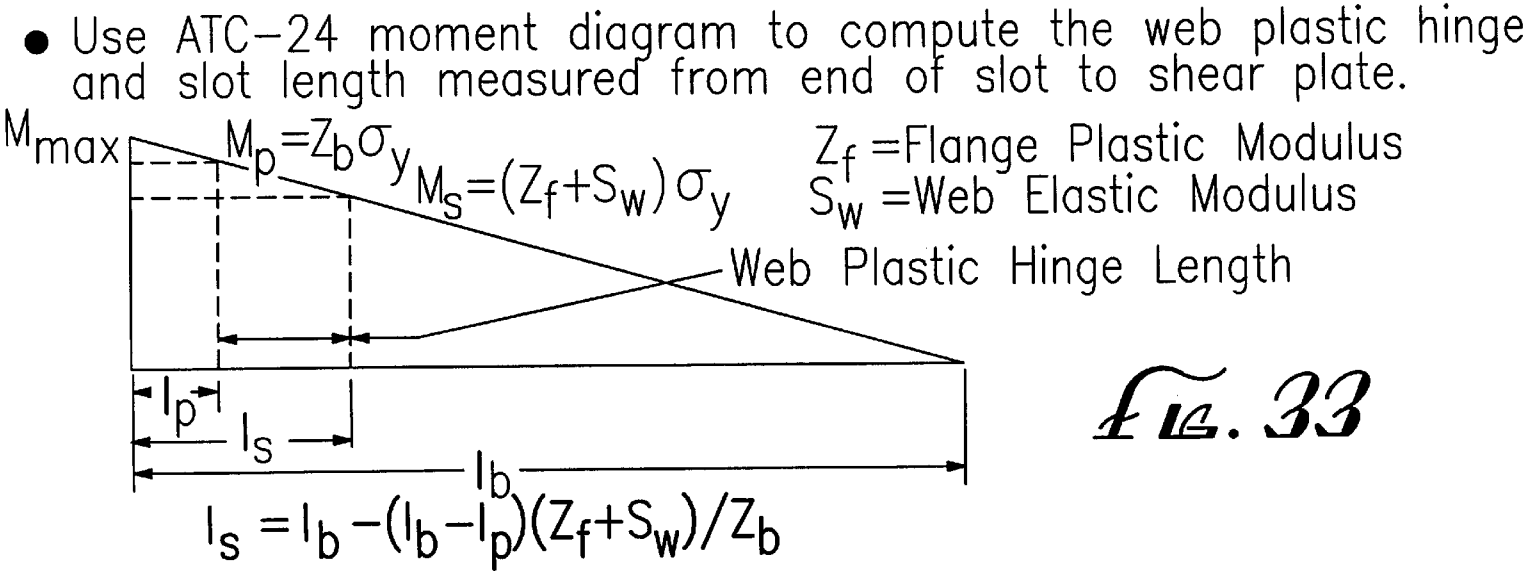
FIG. 33 is a diagram of the ATC-24 moment diagram annotated for design of beam web slot lengths of the present invention.

Referring to FIG. 32, in a preferred embodiment of a W 27×94 (690×140) beam with a 6 inch (15.24 cm) shear plate 230 and a clear span of 24 feet (7.32 m) the vertical fins 311, 313 are equal in length to the shear plate and are 0.75 inches (1.905 cm) thick. Lengths 199, 201 are 6.00 inches (15.24 cm). The slots 192, 196 are 15 inches (38.10 cm) which is the beam's web plastic hinge length as depicted in FIG. 33.

Enlarged Shear Plate Feature of the Present Invention

Figure 15:
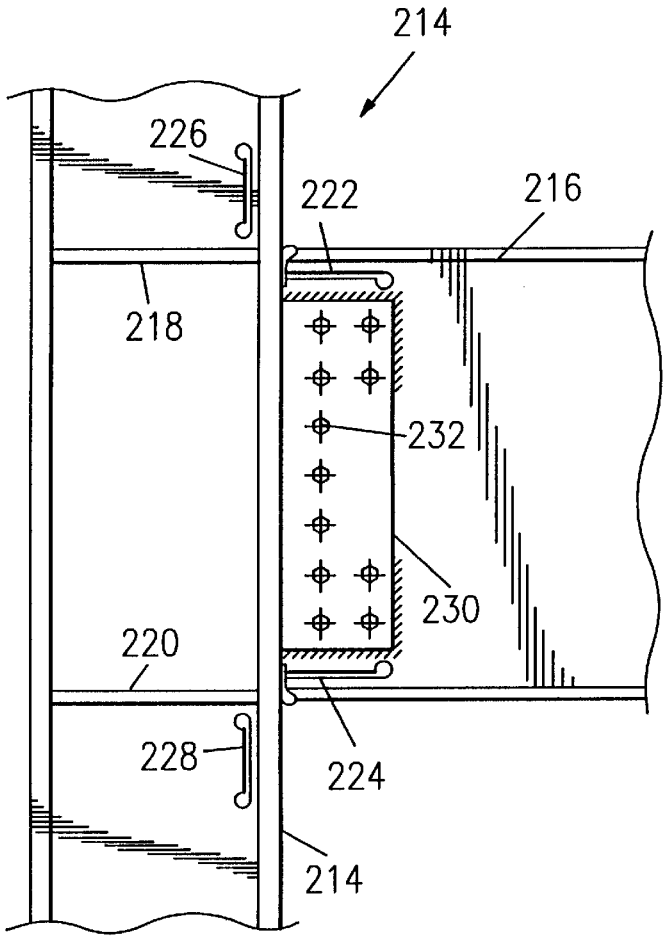
FIG. 15 is a side view of another preferred embodiment of the present invention, including a beam to column connection with the enlarged shear plate and column and beam slot.

Referring to FIG. 15, column 214, beam 216, continuity plates 218 and 220, upper beam slot 222, lower beam slot 224, upper column slot 226 and lower column slot 228 are shown with enlarged shear plate 230. Conventional shear plates typically have a width sufficient to accommodate a single row of bolts 232. In accordance with the present invention, the width of the shear plate 230 may be increased to accommodate up to three columns of bolts 232, with two columns shown. The shear plate 230 of the present invention may be incorporated into the initial design and/or retrofitting of a building. In a typical steel frame construction employing a W 27×94 (690×140) steel beam, a shear plate of approximately 9 inches (22.86 cm) in width would accommodate two columns of bolts. Typically, the bolt hole centers would be spaced apart by 3 inches (7.62 cm). The enlarged shear plate inhibits the premature fracture of the beam web when the beam initiates a failure under load in the mode of a buckling failure.

INDUSTRIAL APPLICABILITY

The present invention may be used in steel frames for new construction as well as in retrofitting, or modifying, steel frames in existing structures. The specific features of the present invention, such as column slots and beam slots, and their location, number, orientation and dimensions will vary from structure to structure. In general, the present invention finds use in the column flange to beam flange interfaces where stress concentrations, as well as strain rate effect due to the stress concentrations, during high loading conditions, such as during earthquakes, are expected to reach or exceed yield strength of the beam, column, or connection elements. Identification of such specific connections in a given structure is typically made through conventional analytical techniques, known to those skilled in the field of the invention. The connection design criteria and design rationale are based upon the principles of plastic design, analyses using high fidelity finite element models, and full scale prototype tests of typical connections in each welded steel moment frame. They employ, preferably, the finite element program, or equivalent to, Version 5.1 or higher of ANSYS in concert with the pre-and post processing Pro-Engineer program or its equivalent. These models generally comprise four node plate bending elements and/or ten node linear strain tetrahedral or eight node hexahedral solid elements. Experience to date indicates models having the order of 40,000 elements and 40,000 degrees of freedom are required to analyze the complex stress and strain distributions in the connections. When solid elements are used, sub-modeling (i.e., models within models) is generally required. Commercially available computer hardware is capable of running analytical programs that can perform the requisite analysis.

The advantages of the invention are several and respond to the uneven stress distribution and buckling modes found to exist at the beam flange/column flange connections in typical steel structures made from rolled steel shapes. Where previously the stress at the beam weld metal/column interface was assumed to be, for design and construction purposes, at the nominal or uniform level for the full width of the joint, the features of the present invention take into account and provide advantages regarding the following:

1. The stress concentration which occurs at the center of the column flange at the welded connection.
2. The strain levels in both the vertical and horizontal orientations across the welded joint.
3. The very high strain rates on the conventional joints at the center of the joint as compared with the very low strain rates at the edges of the joint.
4. The vertical curvature of the column and its effect on the conventional joint of creating compression and tension across the vertical face of the weld.
5. Horizontal curvature of the column flange and its effect on uneven loading of the weldment.
6. The features of the present invention can be applied to an individual connection without altering the stiffness of the individual connection and the beam-column assembly.
7. Conventional analytical programs for seismic frame analysis are applicable with the present invention because application of the present invention does not change the fundamental period of the structure as compared to conventional design methods.
8. The beam slot feature of the present invention eliminates or greatly reduces the lateral-torsional mode of beam buckling when the beam is a part of a structural frame subjected to cyclic or earthquake loading which eliminates the need for lateral flange braces to stabilize the beam flanges.

The stress in the conventional design without continuity plates in the column has been measured to 4 to 5 times greater than calculated nominal stress as utilized in the conventional design. With the improvements of the present invention installed at a connection, we have shown a reduction in stress concentration factor at the "extreme fiber in bending" to a level of about 1.2 to 1.5 times the nominal design stress value. An added enhancement in connection performance has been created by elimination of a compression force in the web side of a flange which is loaded in tension. The elimination of this gradient of stress from compression to tension across the vertical face of the weld eliminates a prying action on the weld metal.

Example of Use of the Present Invention In Mathematical Models

Using a finite element analysis protocol as described above, several displacement analyses were performed on beam to column connections incorporating various features of the present invention, as well as on a conventional connection.

Displacement of the edges of the column flanges and beam flanges was determined with the ANSYS 5.1 mathematical modeling technique.

Figure 16:
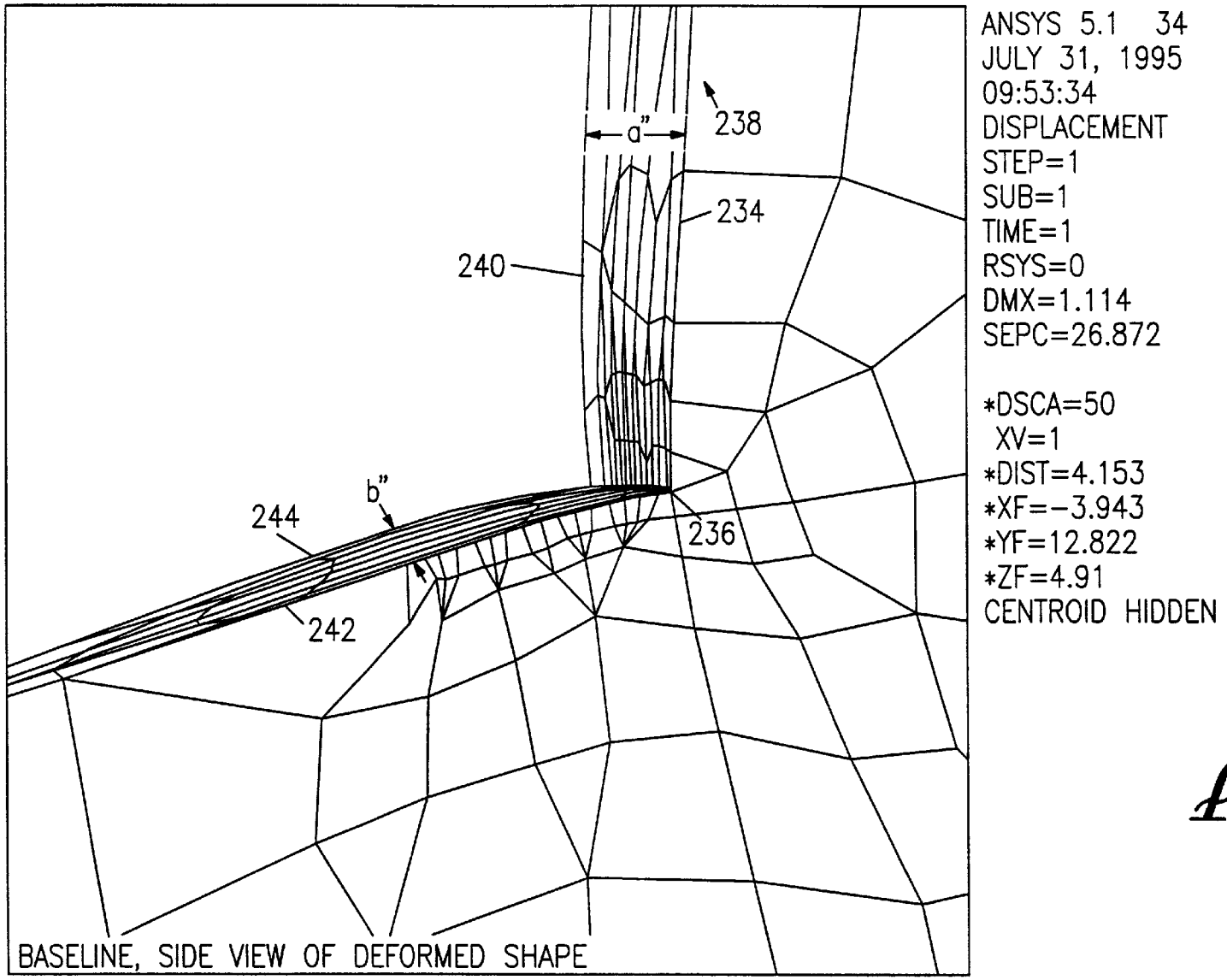
FIG. 16 is a graphical display of the displacement, based on a finite element analysis, of the column and beam flange edges of a conventional beam to column connection when under a load typical of that produced during an earthquake.
Figure 17:
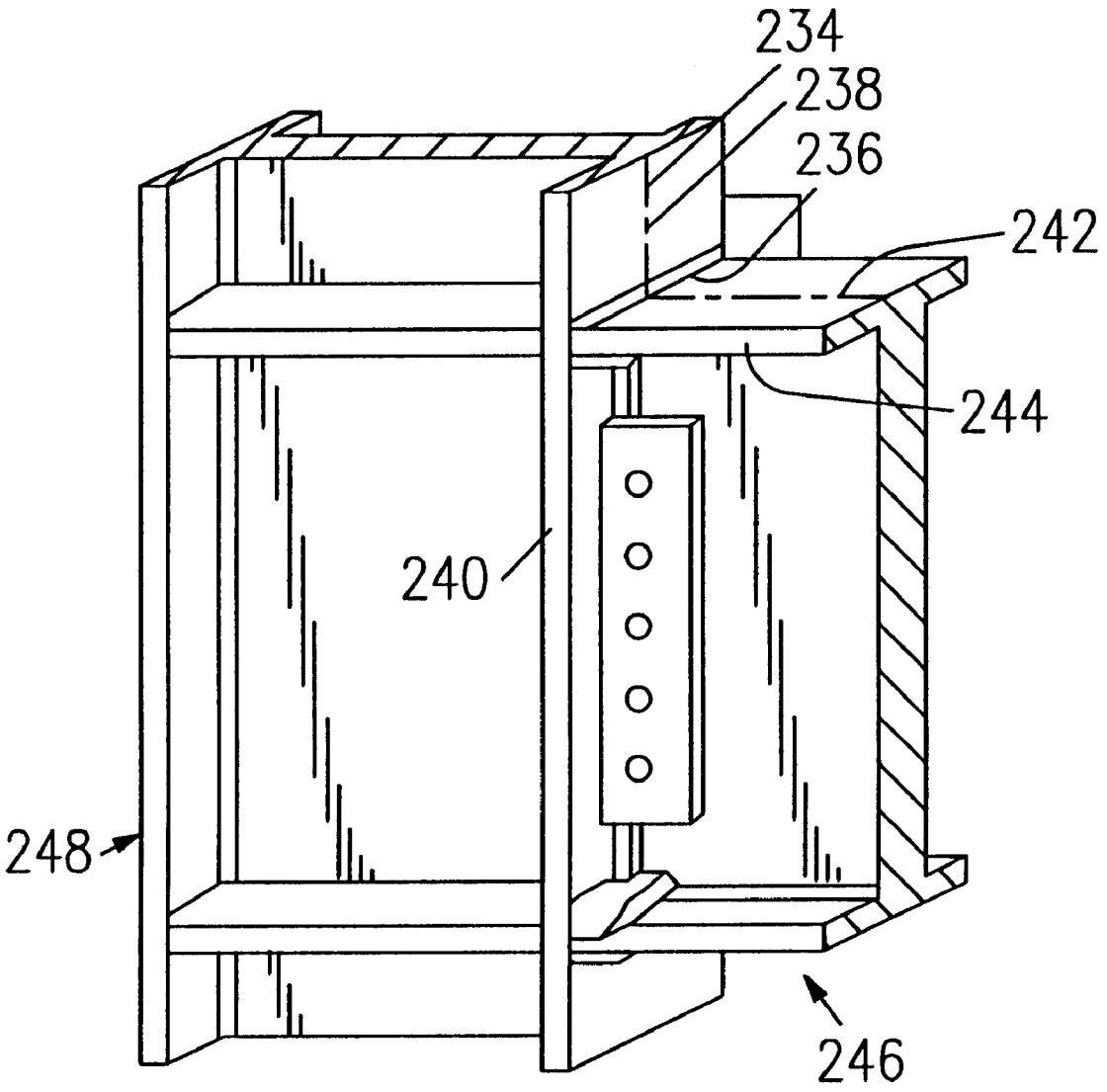
FIG. 17 is a side perspective view of the FIG. 16 connection.

Referring to FIG. 16, a display of the baseline displacement of the beam flange and column flange at a beam to column connection is shown for a conventional beam to column connection under given loading conditions approximating that which would occur during an earthquake. Line 234 represents the centerline of a column flange, with region at 236 being at the connection to a beam flange. Region 238 is near the column flange centerline at some vertical distance away from the connection point of the beam to the column. For example, if region 236 represents a connection at an upper beam flange, then region 238 is a region near the column flange vertical centerline above the beam to flange connection. Line 240 represents a column flange outer edge. Line 242 represents the centerline of the connected beam flange and line 244 represents the beam flange outer edge. Referring to FIG. 17, a side perspective view of a conventional beam 246 to column 248 connection, the column centerline 234 is shown with region 238 vertically above the connection point center at 236. Similarly, beam flange centerline 242 is shown extending along the beam flange, in this case the upper beam flange, which is at the connection of interest. Outer column flange edge 240 and outer beam flange edge 244 are also shown. Referring to FIG. 16, the distance "a" between the left vertical line 240 and the right vertical line 234 generally indicates the displacement of the flange edge during imposed loading. Thus, a great distance between the two lines indicates that there is a significant displacement of the edge 240 of the column flange compared to the column flange along its vertical center line 234 during the given loading event. Similarly, the distance "b" between beam center line 242 and the flange edge 244 is a measure of the displacement of the edge 244 of the beam flange from the center line 242 of the beam flange along its length from the column. FIG. 16 shows the displacement for a conventional column 248 to beam 246 connection, not including any features of the present invention.

Figure 18:
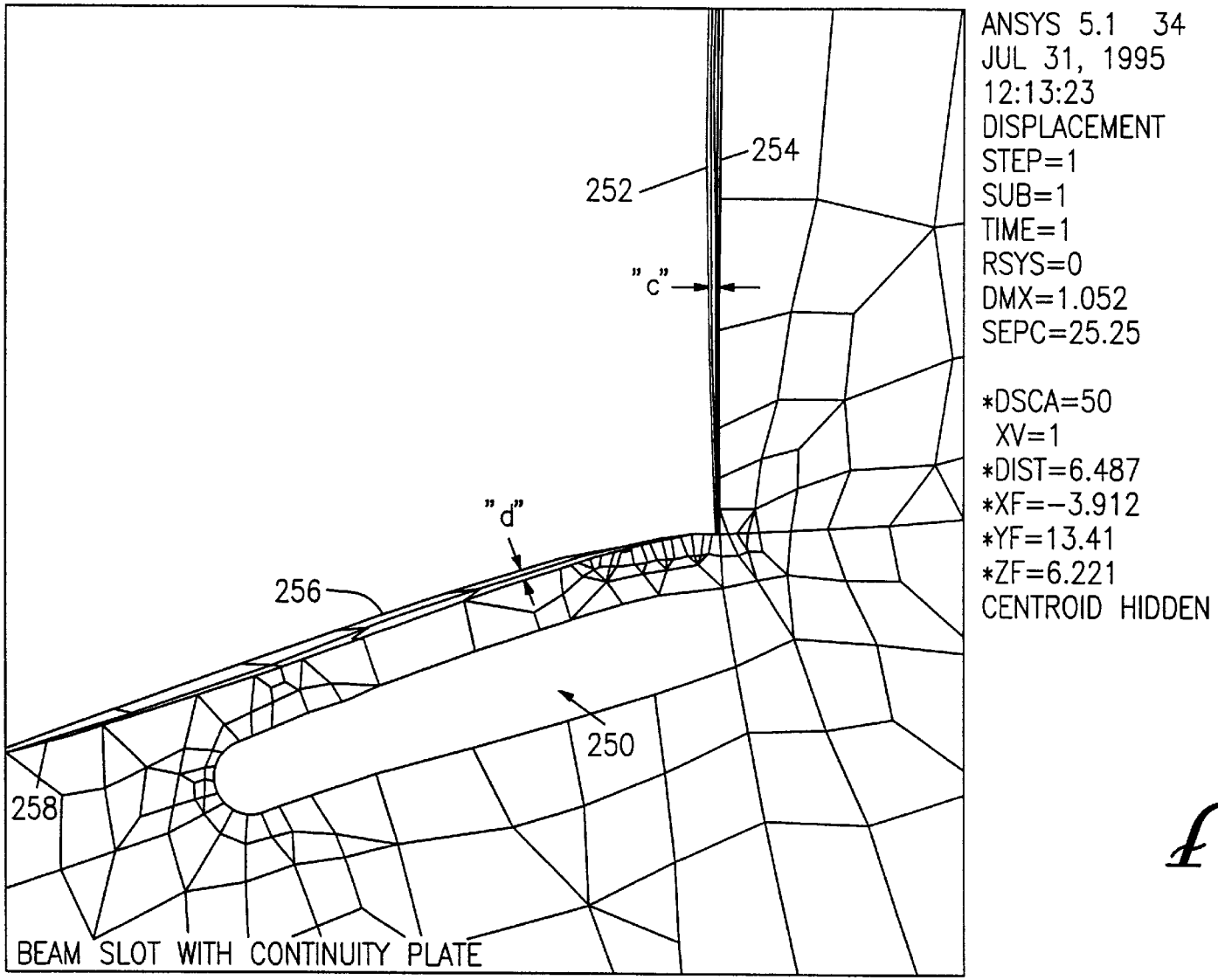
FIG. 18 is a graphical display of flange edge displacement, at the beam to column connection, in a connection using a conventional continuity plate and a horizontal beam slot of the present invention, when under a load typical of that produced during an earthquake.

Referring to FIG. 18, a view of the displacement for a beam to column connection having a beam slot with a continuity plate is shown. In FIG. 18, area 250 represents the beam slot. Line 252 represents the column flange edge, line 254 represents the column center line, line 256 represents the beam flange edge and line 258 represents the beam center line. Distance "c" represents displacement of column flange edge from centerline and distance "d" represents displacement of beam flange edge from beam flange centerline during the loading condition. The distances "c" and "d" represent significant displacements of the edges of the column and beam flanges compared to that of the column and beam centerlines, respectively. As is readily apparent in comparing the distance "a", FIG. 16, to distance "c", FIG. 18, and distance "b" to distance "d", the amount of displacement is significantly less in the case where the beam slot is employed in the steel structure. The reduction of displacement in flange edges between the conventional connection and the connection with beam slots indicates the forces imposed during the loading event are more evenly distributed in the connection with the beam slot.

Figure 19:
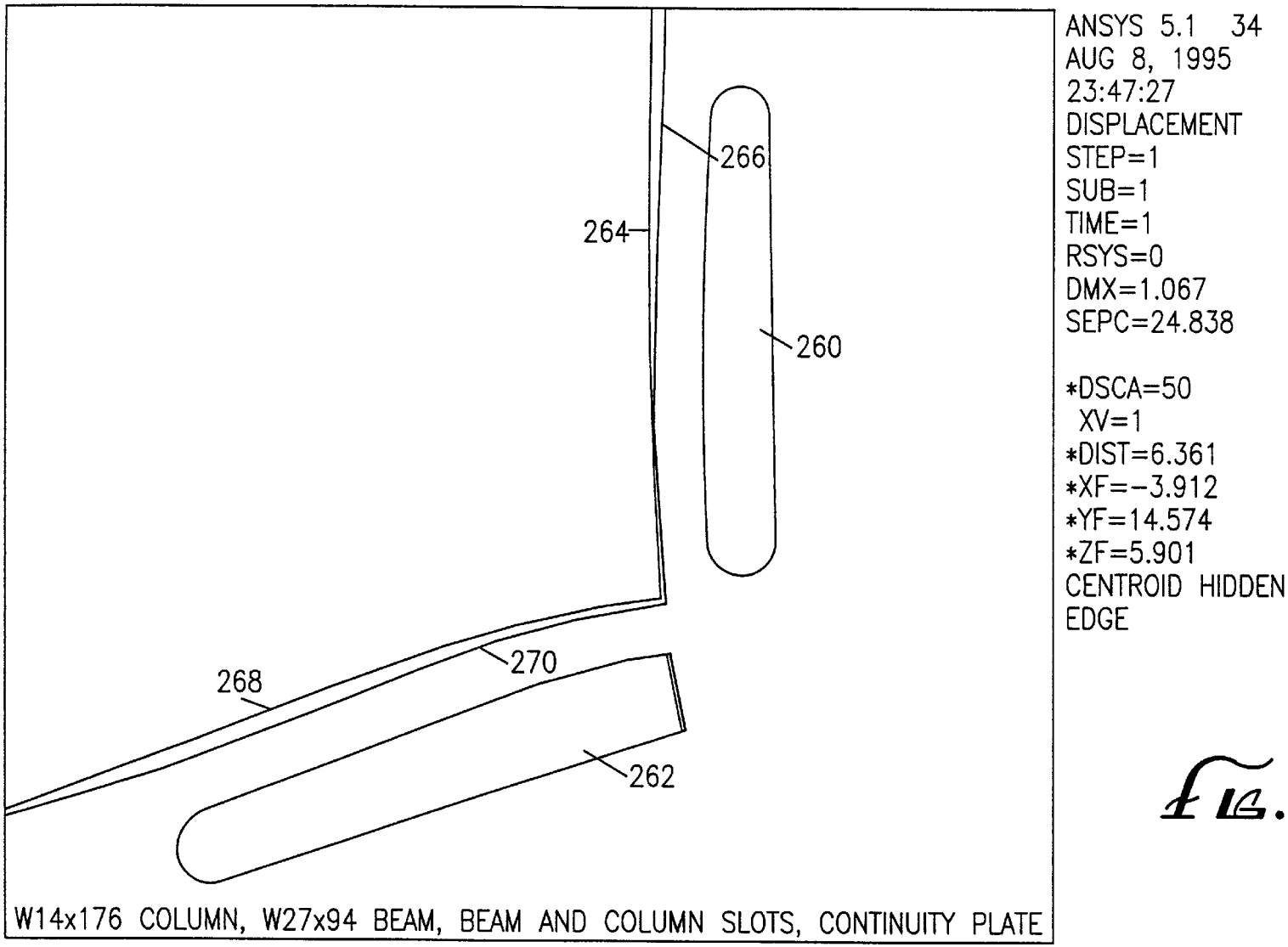
FIG. 19 is a graphical display of flange edge displacement, at the beam to column connection, for a connection with a column having a conventional continuity plate and incorporating beam and column slots of the present invention when under a load typical of that produced during an earthquake.

FIG. 19 is a view of the displacement of column and beam flange edges in a connection having beam and column slots as well as continuity plate for a W 14×176 (35.56 cm×447.04 cm) column, connected to a W 27×94 (68.58 cm×238.76 cm) beam. Region 260 represents the column slot, as described in greater detail above with reference to FIGS. 9, 10, and 12 and region 262 represents a beam slot as described more fully above with reference to FIGS. 9 and 11. Line 264 represents the column flange edge, line 266 represents the column center line, line 268 represents the beam flange edge and line 270 represents the beam flange center line. As is also readily apparent, the distance between the two vertical lines 264 and 266 and the distance between the two generally downwardly sloping, horizontal lines 268, 270, represent significantly less displacement between the edges of the flanges and the center line of the flanges for a connection having a column slot, beam slot and continuity plate than compared to the flange edge displacement in a conventional connection. This reduced displacement, as discussed above, indicates that the connection having beam and column slots with a continuity plate is able to more uniformly distribute the forces applied during the loading than is the conventional connection.

Figure 20:
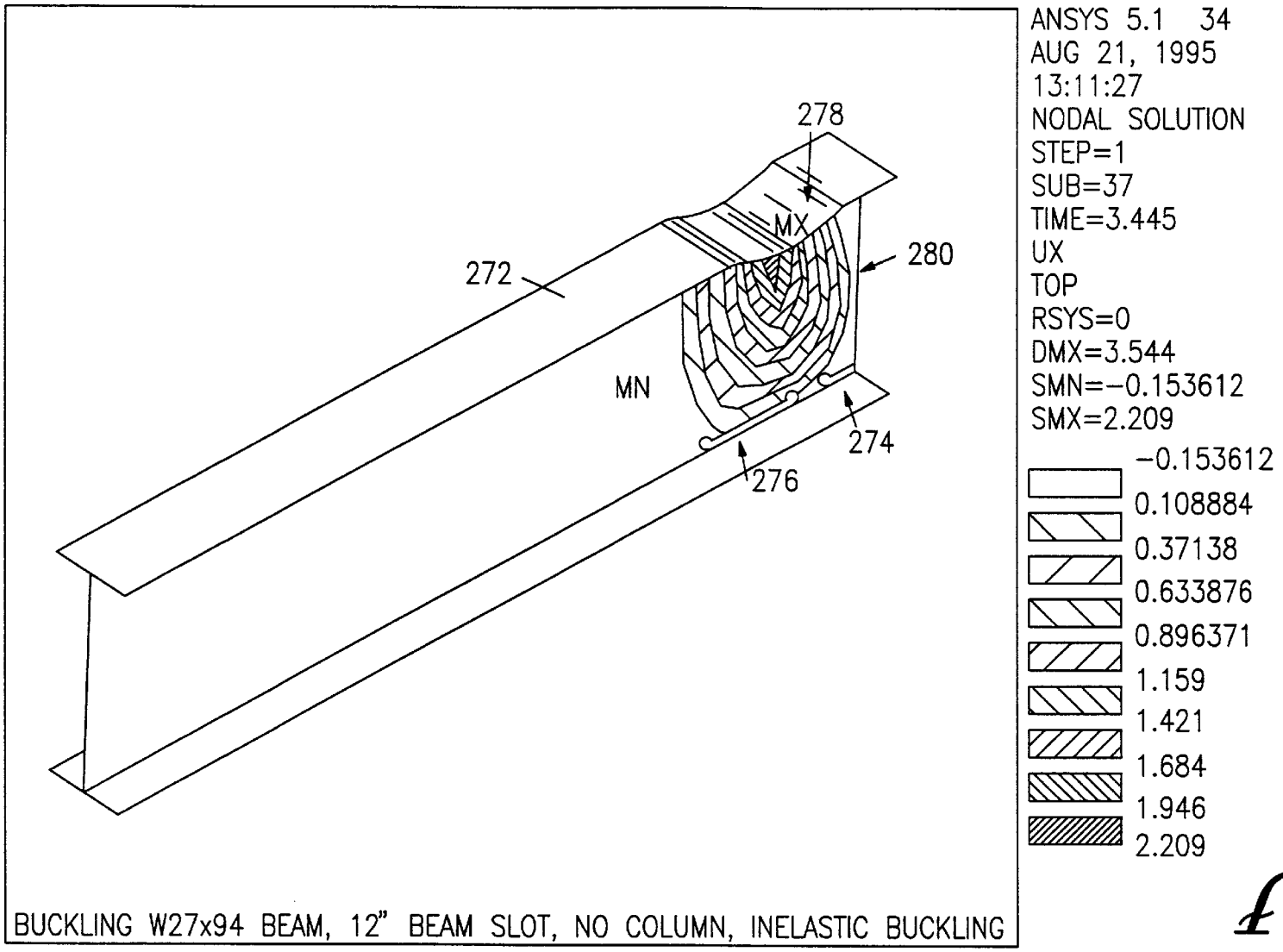
FIG. 20 is a drawing demonstrating buckling mode of a beam, based on a finite element analysis of a beam with single or double beam slots of the present invention, when the beam is part of a structural frame and placed under a loading typical of that produced during gravity or earthquake loadings.

FIG. 20 illustrates buckling of a beam having the beam slots of the present invention. Standard W 27×94 (W690×140) beam 272 includes lower column adjacent beam slot 274 and beam web interior beam slot 276 as shown. corresponding upper first and second beam slots are included in the analysis, but are not shown in FIG. 20 because they would be hidden by the overlapping of the upper beam flange. These beam slots are as described above in regard to FIG. 14. Buckling of the upper beam flange is shown at region 278, with this flange being deformed downward in the region above the beam web interior beam slot and out of its original horizontal plane into a generally U-shape or V-shape. In the web of the beam, buckling deformation takes the shape of the contoured region 280 with the web being forced out of its original vertical plane and into a bulge, extending out of the page, as indicated in FIG. 20. As shown, the plastic hinge region of the beam is between the beam web interior beam slots rather than at the beam to column connection itself.

In the preferred embodiment shown in FIG. 20 the column adjacent beam slots are 6 inches (15.24 cm) in length and the beam web interior beam slots are 12 inches (30.48 cm) in length. The column adjacent beam web slots are separated from the beam web interior beam slots by a beam web length of 6 inches (15.24 cm). This buckling mode, as shown in FIG. 20, of the beam results even if the column adjacent beam web slots of 6 inches (15.24 cm) are eliminated. For example, the column adjacent beam web slots would not be used in the case when they would not be required to reduce the beam flange stress and strain concentrations and rates at the face of the column.

Figure 21:
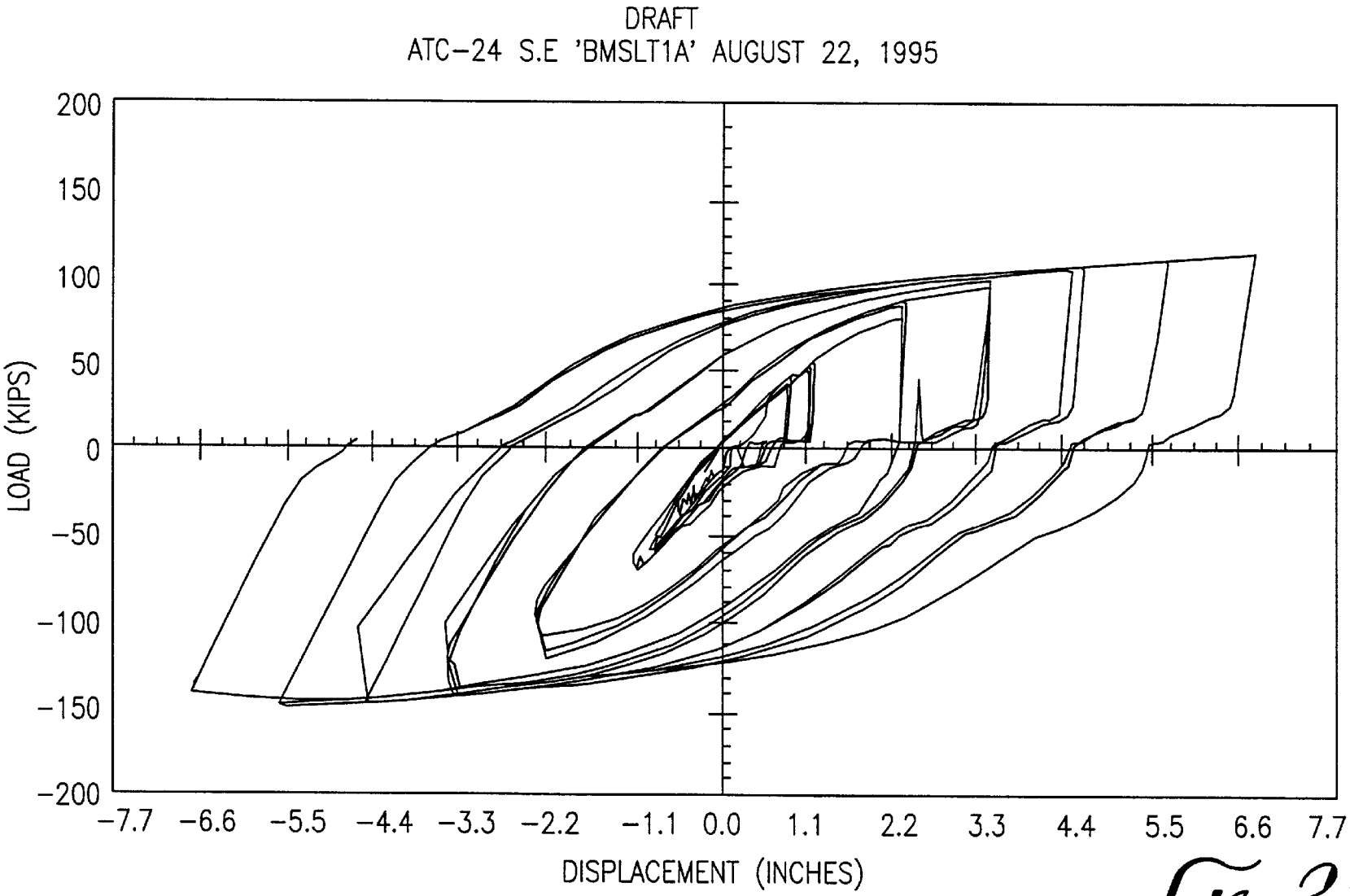
FIG. 21 is a hysteresis loop obtained from a full scale test of a beam to column connection including column and beam slots of the present invention, under simulated seismic loading similar to that resulting from an earthquake.

FIG. 21 is a graph of a hysteresis of a beam to column connection incorporating upper and lower column slots and upper and lower beam slots of the present invention, as shown in FIG. 9. The "hysteresis loop" is a plot of applied cyclic load versus deflection of a cantilever beam welded to a column.

Figure 25:
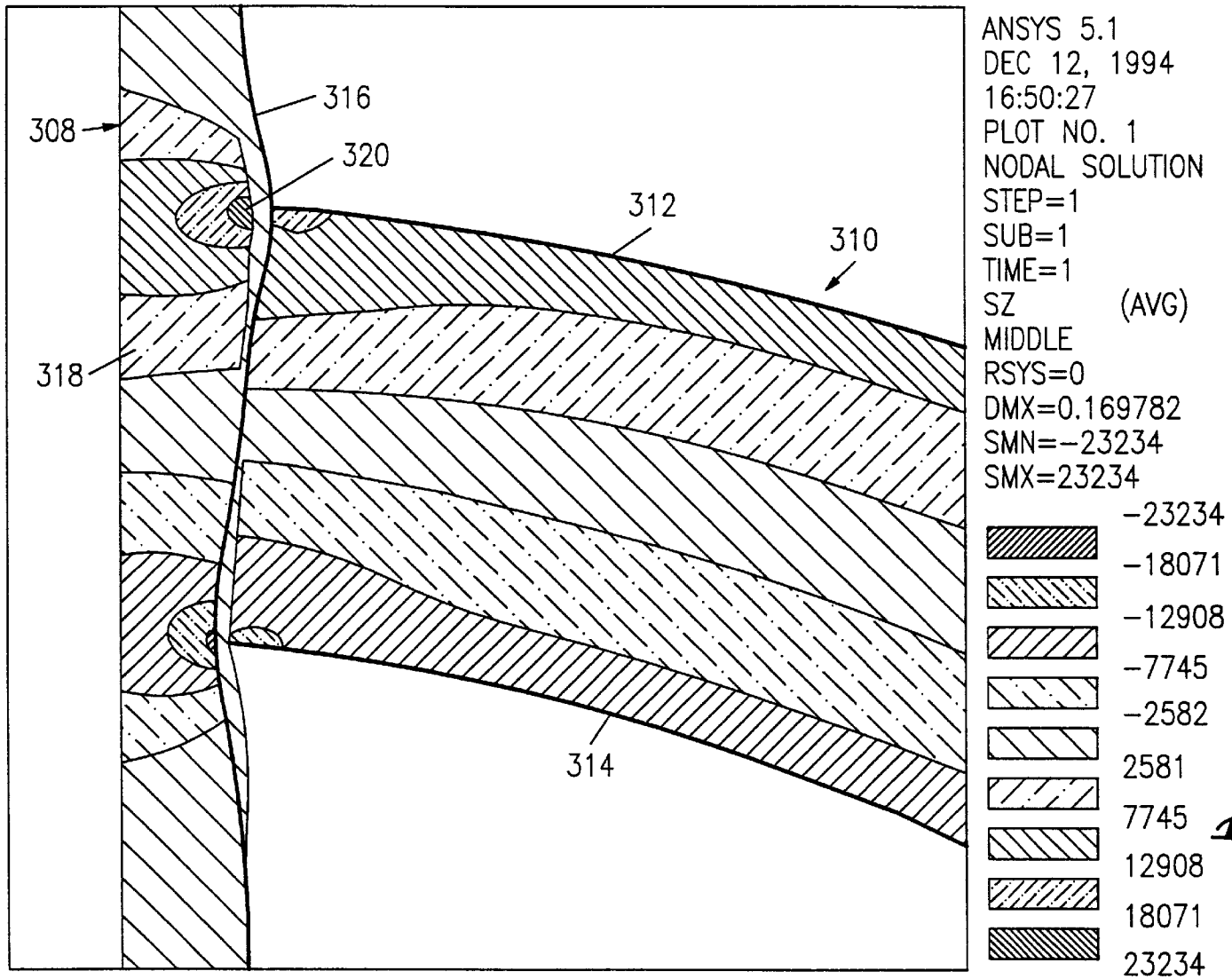
FIG. 25 is a drawing showing stresses in the connection between and at the top and bottom beam flanges.
Figure 26:
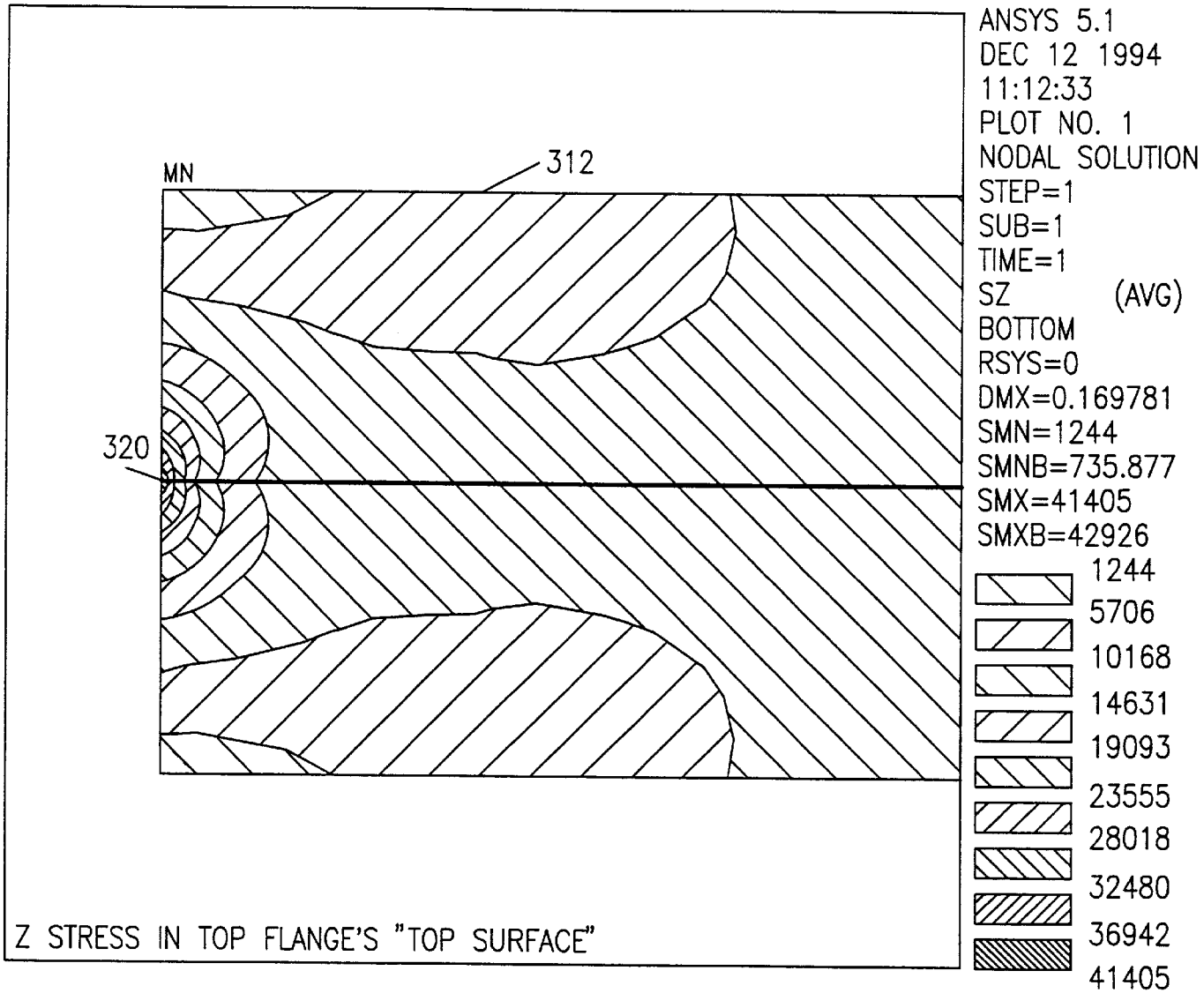
FIG. 26 is a drawing showing stresses in the top beam flange top surface.

Referring to FIGS. 25 and 26, using finite element analysis protocal, it has been discovered that the column 308 and beam 310 exhibit vertical and horizontal curvature due to simulated static or seismic loading of a conventional connection. Due to the vertical curvature of the column flange 316, the beam 310 is subjected to high secondary stresses in the beam flanges 312 and 314. In addition, it has been discovered that horizontal curvature of the column flange 312 occurs due to the tension and compression forces in the beam flanges 312 and 314. High local curvature, which results in high local stress and strain concentration factors, occurs in the beam flanges 312 and 314. These high stress and strain gradients result in a prying action in the beam flanges 312 and 314 at the column flange 316 as shown by the flexural stress contours in FIG. 25 and 26. The stress contours demonstrate how the flexural stresses increase toward the column web 318 and are highest in region 320. The purpose of the beam and/or column slots is to reduce the vertical and horizontal curvatures, and therefore the stresses and strains, of the beam and column flanges as depicted in FIGS. 16, 18, and 19.

Beam Web Weld to Column Flange Feature

Figure 27:
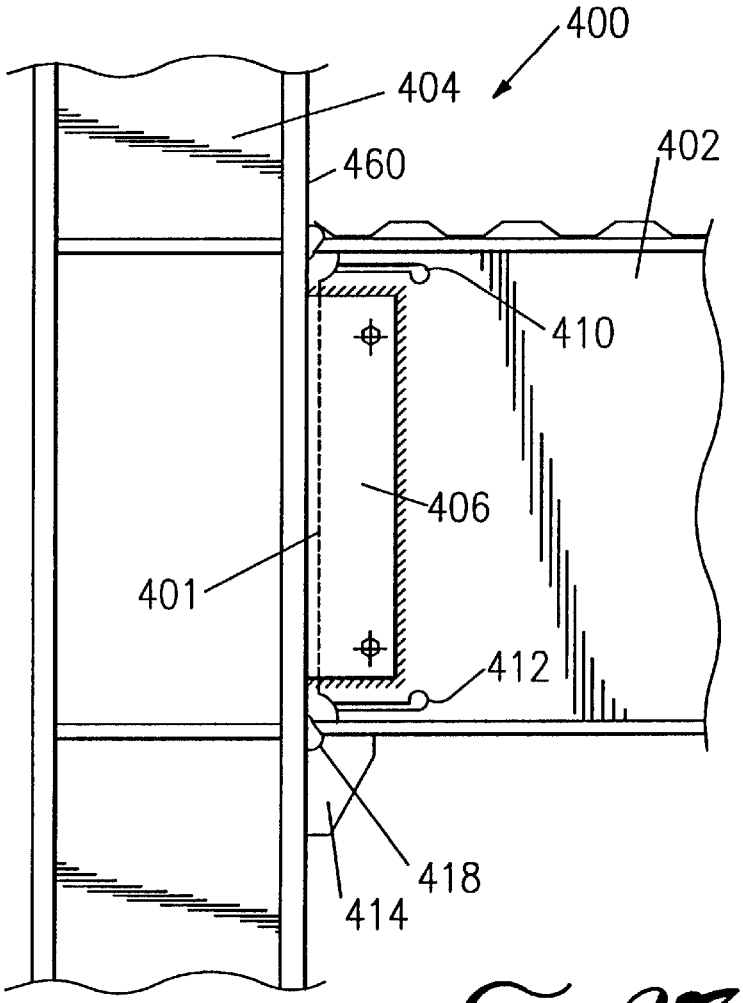
FIG. 27 is a side view of another preferred embodiment of the present invention including a column and beam connection, vertical fins and a weldment of the beam web to the face of the column flange.
Figure 28:
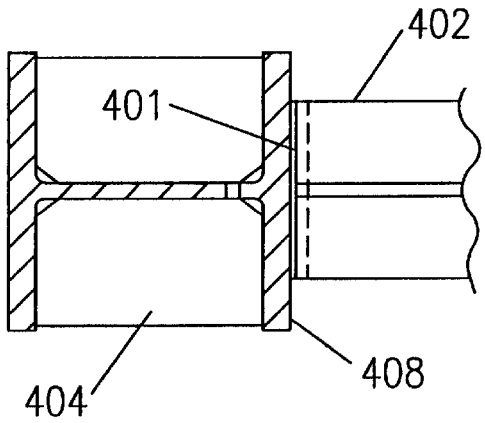
FIG. 28 is a top view of the FIG. 27 embodiment.

It has been discovered that welding the beam web to the column flange provides additional strength and ductility to the connection of the present invention. The preferred embodiment uses a full penetration weld or a square groove weld. Any weld that develops the strength of the beam web over the length of the shear plate is an equivalent weld for this feature. Referring to FIGS. 27 and 28, the connection 400 is shown with beam 402 connected orthogonal to column 404. The beam web is bolted and/or welded to shear plate 406 as well as welded, as shown at 401, to the column flange along the interface. This feature of the slotted beam connection may be used to alleviate and/or avoid the potential of through thickness failure of the column flange. Upper and lower beam slots 410, 412, as described above, are also shown in FIG. 27.

Vertical Fins Feature

It has also been discovered that the slotted beam connection may advantageously use vertical steel fins attached to the beam and column flange interface. Referring to FIG. 27, vertical fin 414 is shown placed below the lower beam and column flange interface 418. Referring to FIG. 34, vertical fins 311, 313 may be used on both the top and bottom beam flange. The vertical fins preferably are steel plates of a triangular configuration, and typically have a thickness equal to the thickness of the beam flange or a minimum thickness of ¾ inch (1.905 cm). Also shown in FIG. 34 are web access holes (not numbered) at the interface of the beam web at the top beam flange and column flange, and, at the interface of the beam web at the bottom beam flange and column flange.

Horizontal Fins Feature

Figure 29:
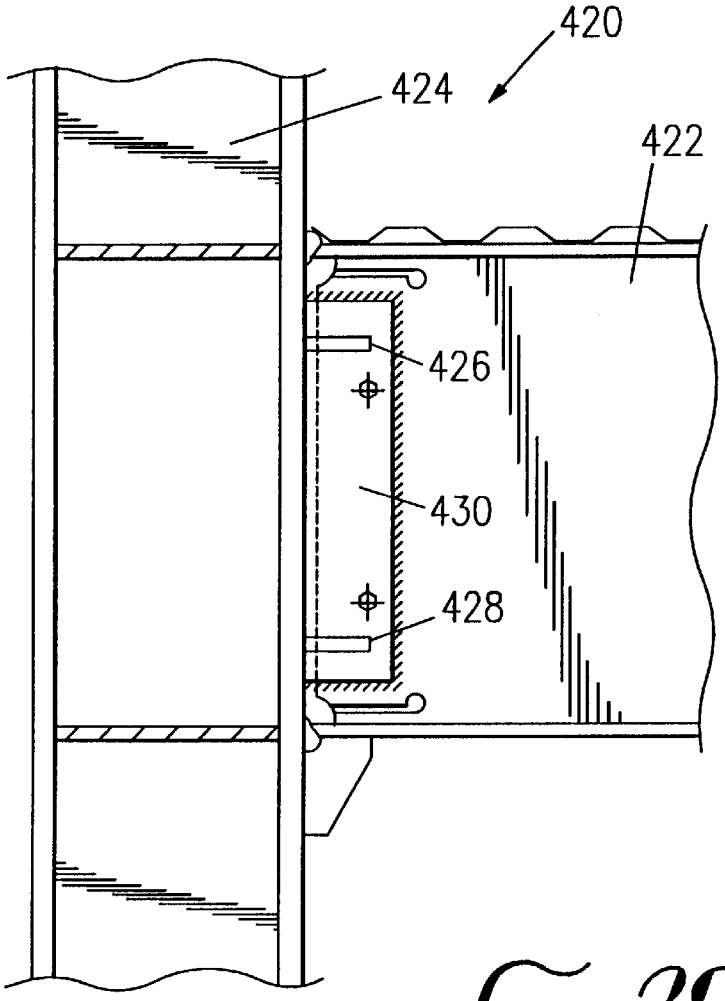
FIG. 29 is a side view of another preferred embodiment of the present invention including a column and beam connection with horizontal fins placed at the interface of the column flange and beam web and/or stiffener plate.

It has also been found that horizontal steel fins preferably of a triangular shape, may also be used advantageously with the slotted beam connection of the present invention. Referring to FIG. 29, the connection 420 is shown having beam 422 connected to column 424. Upper horizontal triangular shaped fin 426 and lower horizontal fin 428 are shown welded to the flange of the column 424 and to the shear plate 430 which in turn is welded and/or bolted to the web of beam 422. Horizontal fins are steel plates typically the same thickness as the beam flange or a minimum of 0.50 inch (1.27 cm). The shear plate and horizontal fins may be used on the front and/or the back side of the beam web.

Applicability of the Present Invention to Box Columns

Figure 30:
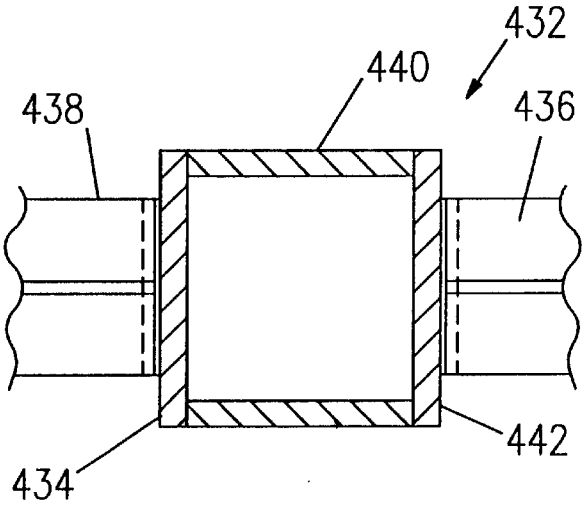
FIG. 30 is a top view of another preferred embodiment of the present invention showing a box column and beam connection.

The slotted connections of the present invention have been illustrated and described for use with I-beam or W-shaped columns. The present invention is useful, however, and in some applications, preferred, when used with a box column. Referring to FIG. 30, connection 432 is shown with beam 436 and beam 438 being connected to box column 440. Preferably, the slotted beam features of the present invention are incorporated into the beams, such as beam 436 and the connection is made to the facing flange 442 of the box column 440. Similarly, on the opposite side, beam 438, incorporating the slot features of the present invention, is connected to flange 434 of the box column 440.

Tapered Slot Feature

Figure 31:
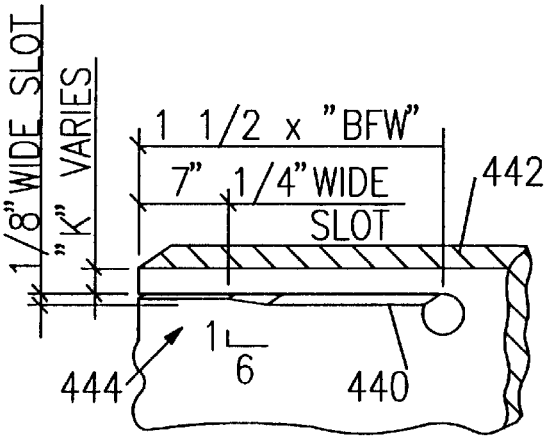
FIG. 31 is a side view of another preferred embodiment of the present invention showing a tapered slot.

It is also been discovered that tapered, or double width beam slots may be used in connections of the present invention. Referring to FIG. 31, for example, a beam slot 440 is shown adjacent to a beam flange 442. Preferably, the slot is relatively narrow in the region shown at 444, near the column flange and, widens along its length in a direction toward the terminus, and away from the adjacent column flange. This tapered slot feature helps control the amplitude of buckling near the column flange so that out of plane beam flange buckling is less pronounced at the column to beam flange interface than it is away form this interface. Typical, and preferred, tapered slots may vary from approximately ⅛ inch to ¼ inch (0.3175 cm×0.635 cm) wide at the column flange, extending approximately to a length equal to the width of the shear plate, for example, 6 inches (17.78 cm), and then widening to about ⅜ inch (0.9525 cm) to the slot terminus. Typically the total slot length is about 1.5 times the beam flange width.

Method for Design of Beam to Column Connections in Steel Moment Frames of the Present Invention As part of the present invention a method for the design of the slotted beam to column connections in steel moment frames has been developed. This design method includes a method for shear plate design and for beam slot design.

Shear Plate Design

The shear plate design includes determination of the shear plate length, height and thickness. Set forth below are the criteria for design.

First, regarding shear plate length design, use the length necessary to accommodate the number of columns of bolts required. For a single column of bolts use a length of 4 inches (10.16 cm) to 6 inches (15.24 cm). Secondly, regarding shear plate height design, use the maximum height that allows for plate weldment and beam web slots. Typically, the height, $h_p$=T−3 inches (7.62 cm), where T is taken from the AISC Design Manual. For example, for a W 36×280 (W 920×417) beam, T=31⅛ inches (79.0575 cm). Thus $h_p$=31⅛−3 (79.0575 cm−7.62 cm)=28 inches (71.12 cm).

Regarding shear plate thickness design, the plate elastic section modulus is used to develop the required beam/plate elastic strength at the column face, using the ATC-24 Moment Diagram as shown in FIG. 32, with annotations for shear plate thickness design. For this calculation, $M_p$ (beam)=$Z_b\sigma_y$ $M_{pl}=M_p(l_s/(l_b-l_s))=Z_b\sigma_y(l_s/(l_b-l_s))$ $M_{pl}=S_{pl}\sigma_y$ where $S_{pl}=t_p h^2_p/6$.

Solving for $t_p$:

$t_p=(6Z_b l_p)/(h^2_p(l_b-l_p))$ or $t_{p\ min}$=⅔×(beam web thickness)

For example:

For a W 36×280 (920×417) beam with $I_b$=168 inches (426.72 cm), $l_p$=6 inches (15.24 cm), and $t_{web}$=0.885 inches (2.25 cm)

$Z_b$=1170 in$^3$ (19,172 cm$^3$), $h_p$=28 inches (71.12 cm) $t_p$=0.33 inches (0.84 cm). Therefore, a shear plate thickness of ⅔×0.885 inches=0.59 inches= approximately 0.625 inches (1.58 cm) should be used.

Determination of Beam Slot Length

Determination of beam slot length involves use of the ATC-24 Moment Diagram as illustrated in FIG. 33.

Referring to FIG. 33, the beam slot length is the shorter of 1.5×(beam flange width) or the web plastic hinge length plus the length of the shear plate.

For example:

For a W 36×194 (W 920×289) beam with beam flange width of 12 inches (30.48 cm), $l_p$=6 inches (15.24 cm), $Z_b$=767 in$^3$ (12568 cm$^3$), $Z_f$=538 in$^3$ (8816 cm$^3$), $S_w$=147 in$^3$ (2405 cm$^3$), then the length of the slot based upon the web plastic hinge length is 23.3 inches (59.2 cm). The length of the slot based upon 1.5×beam flange width is 18 inches (45.7 cm). Therefore use a slot length of 18 inches (45.7 cm).

Notes:

T from the AISC Steel Design Manual $S_b$=beam elastic section modulus, $Z_b$=beam plastic section modulus $l_b$=(beam clear span)/2

Additional Disclosure On Beam Slot Dimensions

In accordance with the principles of the present invention, the preferred beam slot length is the shorter of 1.5×(Nominal Beam Flange Width) or the length of the beam web plastic hinge plus the length of the shear plate. These criteria are based upon the following:

(1) Full scale ATC-24 tests that included beam flange widths of 10 inches (25.4 cm) to 16 inches (40.64 cm).

(2) Finite Element Analyses that included plastic beam web and plastic beam flange buckling.

As so determined, the beam slots accomplish several purposes and/or functions. First, they allow plastic beam flange and beam web buckling to occur independently in the region of the slot. Second, they move the center of the plastic hinge away from the column face, for example, to approximately one half the beam depth past the end of the shear plate. Third, they provide a near uniform stress and strain distribution in the beam flange from near the column face to the end of the beam slot. Fourth, they insure plastic beam flange buckling so that the full plastic moment capacity of the beam is developed. This may be expressed as:

$$l_s/(3\times t_f) \leqq b_f/(2\times t_f) \leqq 65/(F_y)^{1/2}$$

In the embodiment shown in FIGS. 29 and 31, it has been found that the beam slow widths are most preferably approximately ⅛ inch (0.3175 cm) to ¼ inch (0.635 cm) wide or high, as measured from the face of the column to the end of the shear plate. From the end of the shear plate to the end of the slot, the most preferred slot width is ⅜ inch (0.9525 cm) to ½ inch (1.27 cm). It has been discovered that the relatively thin slot at the column face (a) reduces the connection ductility demand by a factor between 5 to 8 and (b) reduces large beam flange curvature near the face of the column. The deeper slot outboard, that is away from the column, allows the beam flange buckling to occur, but limits the buckle amplitude in the central region of the flange.

The Effect of Beam Slots on Connection Stiffness

In accordance with the present invention, Finite Element Analyses, using high fidelity models of the ATC-24 test assemblies, have shown that the beam slots of the present invention did not change the assemblies' elastic force-deflection behavior. Standard finite element programs therefore may be used to design steel frames subjected to static and seismic loadings when slotted beams are used.

Finite Element Analyses, using high fidelity models of the ATC-24 test assemblies, have shown that the beam slots of the present invention did not change the assemblies' elastic force-deflection behavior. Standard finite element programs therefore may be used to design steel frames subjected to static and seismic loadings when slotted beams are used.

Seismic Stress Concentration and Ductility Demand Factors

Ductility and strength attributes of slotted beam-to-column connection designs for steel moment frames of the present invention represent important advances in the state of the art. The slotted beam web designs reduce the Stress Concentration Factor (SCF) at the beam-to-column flange connection from a typical value of 4.6 down to a typical value of 1.4, by providing a near uniform flange/weld stress and strain distribution. This 4.6 SCF, computed by finite element analyses and observed experimentally, exists in the pre-Northridge, reduced beam section (dogbone), and cover plate connection designs. The typical 4.6 SCF results from a large stress and strain gradient across and through the beam flange/weld at the face of the column. For ductile materials the slotted beam SCF reduction decreases the ductility demand in the material at the column flange/beam flange/weld by about an order of magnitude. The relationship between SCFs and ductility demand factors (DDFs) may be expressed as follows: SCF=Computed Elastic Stress/Yield Stress. The DDF may be expressed as: DDF=Strain/Yield Strain−1=SCF−1.

In comparing SCFs and DDFs for conventional connections to connections of the present invention, the base line, or conventional connection includes CJP beam-to-column welds and no continuity plates. The connection of the present invention includes CJP beam-to-column welds, beam slots and, optionally, continuity plates as determined by the analysis and methods described above.

It is believed that the present slotted beam invention (1) develops the full plastic moment capacity of the beam; (2) moves the plastic hinge in the beam away from the face of the column; and (3) results in near uniform tension and compression stresses in the beam flanges from the face of the column to the end of the slot. Moreover, the slotted beam design of the present invention allows the beam flanges to buckle independently from the beam web so that the lateral-torsional plastic buckling mode that occurs in the non-slotted connections is very significantly reduced or eliminated. This latter attribute reduces the torsional moment and torsional stresses in the beam flanges and welds at the column flange and eliminates the need of lateral bracing of the beam flanges that may be required in beams that buckle in the lateral-torsional buckling mode.

While the present invention has been described in connection with what are presently considered to be the most practical, and preferred embodiments, it is to be understood that the invention is not to be limited to the disclosed embodiments, but to the contrary, is intended to cover various modifications and equivalent arrangements included within the spirit of the invention, which are set forth in the appended claims, and which scope is to be accorded the broadest interpretation so as to encompass all such modifications and equivalent structures which may be applied or utilized in such manner to correct the uneven stress, strains and non-uniform strain rates resulting from lateral loads applied to a steel frame.

What is claimed is:

1. A steel framework comprising:

a steel column having a first flange, a second flange, and a web therebetween;

a steel beam having a lower flange, an upper flange, and a web therebetween;

the beam being welded orthogonal to the first flange of the column;

at least one weld access hole in said beam web; and a slot in the beam positioned adjacent to the lower flange of the beam and adjacent to the first flange of the column.

2. A steel framework comprising:

a steel column having a first flange, a second flange, and a web therebetween;

a steel beam having a first flange, a second flange, and a web therebetween;

the beam web being welded orthogonal to the first flange of said column;

a slot in the beam positioned adjacent to the first flange of the beam and adjacent to the first flange of the column; and a slot in the column positioned adjacent to the column flange and to the beam flange nearest to the beam slot.

3. A steel framework comprising:

a steel column having a first flange, a second flange, and a web therebetween;

a steel beam having a first flange, a second flange, and a web therebetween;

the beam web being welded orthogonal to the first flange of the column and including at least one weld access hole;

a first slot in the beam positioned adjacent to the first beam flange and to the first column flange; and a second slot in the beam positioned adjacent to the second beam flange and to the first column flange.

4. A steel framework comprising:

a steel column having a first flange, a second flange, and a web therebetween;

a steel beam having a first flange, a second flange, and a web therebetween;

the beam web being welded orthogonal to the first flange of the column;

a first slot in the beam positioned adjacent to the first beam flange and to the first column flange;

a second slot in the beam positioned adjacent to the second beam flange and to the first column flange; and a slot in the column positioned adjacent to the column flange and to the beam flange nearest to the first beam slot.

5. A steel framework comprising:

a steel column having a first flange, a second flange, and a web therebetween;

a steel beam having a lower flange, an upper flange, and a web therebetween;

the beam being welded orthogonal to the first flange of said column and including at least one weld access hole;

a slot in the beam positioned adjacent to the lower flange of said beam and adjacent to the first flange of the column; and a continuity plate extending between the first and second column flanges and being coplanar with the first beam flange.

6. A steel framework comprising:

a steel column having a first flange, a second flange, and a web therebetween;

a steel beam having a first flange, a second flange, and a web therebetween;

the beam web being welded orthogonal to the first flange of the column;

a slot in the beam positioned adjacent to first flange of the beam and adjacent to the first flange of the column; a slot in the column positioned adjacent to the column flange and to the beam flange nearest to the beam slot; and a continuity plate extending between the first and second column flanges and being co-planar with the first beam flange.

7. A steel framework comprising:

a steel column having a first flange, a second flange, and a web therebetween;

a steel beam having a first flange, a second flange, and a web therebetween;

the beam web being welded orthogonal to the first flange of the column and including at least one weld access hole;

a first slot in the beam positioned adjacent to the first beam flange and the first column flange;

a second slot in the beam positioned adjacent to the second beam flange and to the first column flange; and a continuity plate extending between the first and second column flanges and being coplanar with the first beam flange.

8. A steel framework comprising:

a steel column having a first flange, a second flange, and a web therebetween; a steel beam having a lower flange, an upper flange, and a web therebetween;

the beam being welded orthogonal to the first flange of the column and including at least one weld access hole;

a slot in the beam positioned adjacent to the lower flange of the beam and adjacent to the first flange of the column; and a shear plate welded on the web of said beam and having a length, height and width dimension extending between the first and second beam flanges, and the width dimension extending perpendicular to the height dimension and along the web of the beam, flange and a first web and a second web therebetween;

a steel beam having a lower flange, an upper flange, and a web therebetween;

the beam being welded orthogonal to the first flange of the column; and a slot in the beam positioned adjacent to the lower flange of the beam and adjacent to the first flange of the column.

9. The framework of claim 1 wherein the slot has a height, a thickness, a first end and a second end and the slot in the beam is cut entirely through the thickness of the beam web;

the first end being at the edge of the beam web near the welded connection; and the second end being at a predetermined distance from the welded connection.

10. The framework of claim 9 wherein the second end comprises a circular hole having a diameter greater than the height of the slot.

11. The framework of claim 1 further including:

the slot in the beam having a width, a thickness and a length dimension;

the thickness of the slot in the beam being equal to the thickness of the beam web, and the width of the slot in the beam having a tapered width from a first end near the first column flange to a second end;

the slot in the column having a width, a thickness, a length dimension and two ends; and a slot in the column terminating tangentially at the two ends, each end being a circular hole having a diameter greater than the width dimension.

12. The framework of claim 1, further including a welded connection of the beam web to the first flange of the column.

13. The framework of any of claims 1–12 further including a triangular shaped steel fin attached to the beam and column flange interface.

14. The framework of any of claims 1–12 further including a triangular shaped steel fin attached to the column flange and beam web or shear plate interface.

15. The framework of any of claims 1–10 wherein each slot is tapered from a first slot width near the column and beam interface to a second slot width near the opposite end of the slot and wider than the first slot width.

16. A steel framework comprising:

a steel box column having a first flange, a second flange and a first web and a second web therebetween;

a steel beam having a lower flange, an upper flange, and a web therebetween;

the beam being welded orthogonal to the first flange of the column; and a slot in the beam positioned adjacent to the lower flange of the beam and adjacent to the first flange of the column.

17. A steel framework structure comprising:

a column having a pair of flanges and a web;

a steel beam welded to a flange of said column; and a vertically oriented slot in said column positioned adjacent to at least one flange of said beam.

18. A steel framework structure comprising:

a column having a pair of flanges and a web;

a beam having a pair of flanges, a web and at least one weld access hole;

said beam having an end joined to an outer flange surface of said column to form a connection;

said column flanges being connected to said column web at inner faces of said column flanges along the lengthwise centerlines of said column flanges;

means for uniformly distributing the magnitude of stress and the strain rate across said end of said beam near said connection; and wherein said stress and strain distribution means reduces the mean time between failures of said connection.

19. The framework structure of clai 17 further comprising a vertical plate connected between said column flanges positioned adjacent to at least one of said beam flanges.

20. The framework structure of claim 19 further comprising a horizontal plate connected between said vertical plate and said web positioned adjacent to at least one of said beam flanges, said horizontal plate having a surface trapezoidal in shape.

21. The framework of each of claims 1, 2, 5, 6, 8 or 9 further including a second slot in the beam positioned adjacent the said slot in the lower flange of the beam.

22. The framework of each of claims 3, 4 or 7 further including a third slot in the beam adjacent the first slot and a fourth slot in the beam adjacent the second slot.

23. The framework of any of claims 1 through 11 wherein each slot has a length of 1.5 times the nominal beam flange width.

24. The framework of any of claims 1–10 wherein each slot is tapered from a width of about ⅛ inch (0.3175 cm) at the column flange to a width from about ⅜ inch (0.9525 cm) to about ½ inch (1.27 cm) at it's opposite end.

25. A method of quantifying stress and strain concentration factors in a welded steel moment frame connection comprising:

selecting a welded steel moment frame connection:

selecting a high fidelity finite element model including at least 40,000 elements and at least 40,000 degrees of freedom for said connection;

conducting a finite element stress analysis of said connection by:

executing a computer-implemented finite element analysis program for said model and using predetermined stress and strain values; and generating stress and strain concentration factors for design of said welded steel moment frame connection.

26. A steel framework comprising:

a steel column having a first flange, a second flange, and a web therebetween;

a steel beam having a first flange, a second flange, and a web therebetween;

the beam web being welded orthogonal to the first flange of the column; and a slot in the beam, with said slot having an upper edge, a lower edge, a first end edge and a second end edge, all four edges being formed by the beam web.

27. A steel framework comprising:

a steel column having a first flange, a second flange, and a web therebetween;

a steel beam having a first flange, a second flange, and a web therebetween;

said beam web having a slot therein and said slot being surrounded on four sides by said beam web.

28. The steel framework of claims 26 or 27 further including a weld access hole positioned between said beam slot and said first column flange.

29. A steel framework comprising:

a steel column having a first flange, a second flange, and a web therebetween;

a steel beam having an upper beam flange, a lower beam flange, and a beam web therebetween;

the beam web being welded orthogonal to the first flange of the column;

at least one weld access hole in said beam web; and a beam slot having a first end, a second end, a length dimension extending between said first end and said second end and said first end being closer to said first column flange than said second end; and said beam slot being formed in said beam web and positioned nearer said upper beam flange than said lower beam flange.

30. A steel framework comprising:

a steel column having a first flange, a second flange, and a web therebetween;

a steel beam having a lower flange, an upper flange, and a web therebetween;

the beam being welded orthogonal to the first flange of the column;

at least one weld access hole in said beam; and a slot in the beam positioned adjacent to the lower flange of the beam and separated from the first flange of the column by a predetermined length of beam web.

31. A steel framework comprising:

a steel column having a first flange, a second flange, and a web therebetween;

a steel beam having a first flange, a second flange, and a web therebetween;

the beam web being welded orthogonal to the first flange of said column;

a slot in the beam positioned adjacent to the first flange of the beam and adjacent to the first flange of the column; and a slot in the column positioned adjacent to the column flange and to the beam flange nearest to the beam slot.

32. A steel framework comprising:

a steel column having a first flange, a second flange, and a web therebetween;

a steel beam having a first flange, a second flange, and a web therebetween;

the beam web being welded orthogonal to the first flange of the column and including at least one weld access hole;

a first slot in the beam positioned adjacent to the first beam flange adjacent to the first column flange; and a second slot in the beam positioned adjacent to the second beam flange but not adjacent to the first column flange.

33. A steel framework comprising:

a steel column having a first flange, a second flange, and a web therebetween;

a steel beam having a first flange, a second flange, and a web therebetween;

the beam web being welded orthogonal to the first flange of the column and including at least one weld access hole;

a first slot in the beam positioned adjacent to the first beam flange but not adjacent to the first column flange;

a second slot in the beam positioned adjacent to the second beam flange and in the proximity of but not adjacent to the first column flange; and a continuity plate extending between the first and second column flanges and being coplanar with the first beam flange.

34. A steel framework comprising:

a steel column having a first flange, a second flange, and a web therebetween; a steel beam having a lower flange, an upper flange, and a web therebetween;

the beam being welded orthogonal to the first flange of the column and including at least one weld access hole;

a slot in the beam positioned adjacent to the lower flange of the beam but not adjacent to the first flange of the column; and a shear plate welded on the web of said beam and having a length, height and width dimension extending between the first and second beam flanges, and the width dimension extending perpendicular to the height dimension and along the web of the beam.

35. A steel framework including a plurality of columns and beams connected to form said framework, the improvement comprising:

a slot positioned in at least one beam of said framework, with the slot being surrounded by beam web and positioned so that a predetermined length of beam web separates the column from the end of the beam slot closest to the column.

* * * * *